US006380686B1

(12) United States Patent
Kim et al.

(10) Patent No.: US 6,380,686 B1
(45) Date of Patent: Apr. 30, 2002

(54) METHOD AND APPARATUS FOR DISPLAYING CHARACTERS AND/OR IMAGES

(75) Inventors: Jae Chul Kim; Yung Chul Kim, both of Inchon; Ho Guen Park, Kimpo, all of (KR)

(73) Assignee: Prochips Technology Inc. (KR)

( * ) Notice: Subject to any disclaimer, the term of this patent is extended or adjusted under 35 U.S.C. 154(b) by 0 days.

(21) Appl. No.: 09/701,805

(22) PCT Filed: Jun. 1, 1999

(86) PCT No.: PCT/KR99/00268

§ 371 Date: Dec. 1, 2000

§ 102(e) Date: Dec. 1, 2000

(87) PCT Pub. No.: WO99/63509

PCT Pub. Date: Dec. 9, 1999

(30) Foreign Application Priority Data

Jun. 3, 1998 (KR) ..... 98/9423
Jan. 26, 1999 (KR) ..... 99/2358

(51) Int. Cl.[7] ..... G09G 3/10

(52) U.S. Cl. ..... 315/169.2; 315/169.1; 315/169.3; 315/226; 313/509; 345/77

(58) Field of Search ..... 315/169.1, 169.2, 315/169.3, 224

(56) References Cited

U.S. PATENT DOCUMENTS 4,283,660 A * 8/1981 Curry ..... 315/169.2
6,069,450 A * 5/2000 Sakai et al. ..... 315/169.1
6,246,180 B1 * 6/2001 Nishigaki ..... 315/169.3

FOREIGN PATENT DOCUMENTS

WO PCT/EP97/03145 12/1997 ..... G09F/9/33
WO PCT/EP98/00284 7/1998 ..... G09G/3/00

* cited by examiner

*Primary Examiner*—Don Wong
*Assistant Examiner*—Jimmy T. Vu
(74) *Attorney, Agent, or Firm*—Webb Ziesenheim Logdson Orkin & Hanson, P.C.

(57) ABSTRACT

The method of the present invention includes the first step of applying power to a character and/or image display apparatus and setting up input/output port values and initialization values, the second step of initializing all LED values and clearing a screen, the third step of reading initial picture data from a nonvolatile backup memory, the fourth step of writing the data read from the backup memory into a working memory, the fifth step of reading initialization data from the working memory, the sixth step of displaying an initial picture and performing a still mode until a rotation speed of a motor becomes stable, the seventh step of reading data other than the initialization data from the working memory, the eighth step of sequentially performing modes corresponding to commands contained in the read data, and the ninth step of repeating the above seventh and eighth steps until all commands stored in the working memory are processed.

20 Claims, 18 Drawing Sheets

(a)

(b)

510

METHOD AND APPARATUS FOR DISPLAYING CHARACTERS AND/OR IMAGES

TECHNICAL FIELD

The present invention relates to a method and an apparatus displaying characters and/or images using the rotation of light emitting diodes (LEDs), and more specifically, to an apparatus for displaying a bit map image from a basic display unit of 24 dots (vertical)×256 dots (horizontal)×1 (color) up to a display unit of 64 dots×512 dots×3 (full color) or more.

BACKGROUND ART

A conventional image display apparatus is shown in PCT Application No. PCT/EP97/03145, filed on Jun. 17, 1997 by Lumino Company in Germany. This image display apparatus comprises a casing made of a transparent and/or semi-transparent material, which contains an electric motor. The electric motor has a rotary shaft rotating around a symmetry axis. Rotatably mounted to the motor shaft is a rotary wing assembly on which a series of LEDs are attached in the vertical direction of the motor shaft.

The conventional image display apparatus further comprises a logic control board for controlling the above LEDs, and a photoelectronic measurement device for measuring a rotation speed of the rotary wing assembly. The photoelectronic measurement device includes a transmitter/receiver unit mounted to a rotary part of the apparatus at its one end and to a stationary part of the apparatus at its other end, both ends being spaced at a short distance from each other and facing each other at the opposite sides.

The conventional image display apparatus further comprises a mechanical balance unit provided at a position symmetrically opposite to the rotary wing assembly. The balance unit has an arbitrary sectional area and may preferably be a bar adjustable in length. The conventional apparatus keeps its balance by adjusting the length of the bar, which maintains its horizontal state while the motor rotates, or while the apparatus is operated.

This display apparatus is adapted to display a bit map image in a basic display unit of 16 dots (vertical)×256 dots (horizontal)×1 (color). Further, the apparatus is disadvantageous in that it provides no color expression and is very short in life due to mechanical defects. The motor shaft of the display apparatus is asymmetrical around the symmetrical axis.

Another conventional technique related to the image display is disclosed in Japanese Patent Laid-open Publication No. Heisei 2-61693 (Mar. 1, 1990), which shows a contactless energy transfer technique for supplying power from a generator to a control unit.

Another conventional technique related to the image display is disclosed in PCT Application No. PCT/EP98/00284, filed on Jan. 20, 1998 by Lumino Company in Germany, which shows a display apparatus wherein the transfer of energy to a logic control unit for control of LEDs is conducted in a contactless induction manner as in the above Japanese publication. This display apparatus is desirable to use a generator, transformer or electrostatic capacitor for the energy transfer, but has a disadvantage in that it has no feedback arrangement for accurately performing the energy transfer.

The above display apparatus employs a pole shading motor, which is simple in construction, but low in efficiency, resulting in a large amount of heat being generated. The pole shading motor further employs a light amateur as its rotor, thereby exhibiting a severe variation in its rotation speed due to an air resistance or weight even after it reaches a predetermined speed.

The above conventional display apparatus further comprises a serial electrically erasable and programmable read only memory (EEPROM) as a backup memory for storing data to be displayed by the logic control unit for the control of the LEDs. As a result, a larger amount of data to be stored increases the amount of memory load and, in turn, a processing time.

FIG. 1*a* is a front view of a conventional LED, indicated by the reference numeral 120. As shown in this drawing, the LED 120 consists of three parts, a head 122, a flange 124 and legs 126, configured in one LED chip, and is of a single-color type. In the case where a plurality of LEDs, for example, sixteen LEDs, each of which is the LED 120, are mounted to a rotary wing assembly, the adjacent ones of them have a gap therebetween resulting from the flanges 124 over the legs 126, which leads to a reduction in resolution, thereby making it impossible to express a fine image or characters. Further, adjacent pads cannot help being arranged apart from each other at a distance resulting from the flanges 124, thereby causing the LEDs 120 to be arrayed on both sides of the pads. Here, the pads signify copper foils on which the LED legs 126 are soldered and fixed.

In a conventional display apparatus, a logic control unit is inserted into a motor shaft via a hole. This hole is not positioned in the center of the circular portion but leans toward the rear of the circular portion, and this circular portion has no cover, thereby making it difficult to assemble the apparatus.

Further, the conventional display apparatus is adapted to adjust the length of a balance plate so as to keep its balance during its rotation. Also, the motor body is not rotated symmetrically about the motor shaft. Moreover, only the logic control unit is coupled with the motor shaft such that it rotates.

The conventional display apparatus comprises a transmitter and a receiver mounted to the lower part of the logic control unit separately from each other. This apparatus further comprises a reflector mounted to its stationary part. With this construction, the logic control unit is adapted to detect a light beam reflected by the reflector. As a result, a photoelectronic measurement device of this display apparatus is degraded in performance due to noise, etc., as compared with a transmission-type device.

Conventionally, a secondary voltage is generated and transferred either in a contact manner or in a contactless manner. A contact-type secondary voltage generation/transfer method, for example, a brush method is adapted to transfer an external direct current (DC) supply voltage to a secondary side through a contact surface of a brush. A contactless-type secondary voltage generation/transfer method, for example, a generator method is adapted to utilize a voltage induced in a generator with rotation as a secondary voltage. In this case, the generator acts as a converter for converting an alternating current (AC) voltage into a DC voltage. Also, a regulator is used to convert a voltage of +8V or more into a voltage of +5V. However, in the contactless-type method, a secondary voltage is not induced under the condition of no rotation, which leads to a reduction in rotation speed and occurrence of noise when the amount of load on the secondary side is increased. Therefore, it is impossible to raise the resolution by increasing the number of LEDs and, in turn, the number of dots.

In the contact-type secondary voltage generation/transfer method, no distinction is made between a primary voltage and a secondary voltage. The contactless-type secondary voltage generation/transfer method employs a personal computer (PC) serial communication port for inputting external data.

The conventional display apparatus has no front board acting as a keyboard. Further, this apparatus has a unitary body and a display bulb colored only brown.

DISCLOSURE OF THE INVENTION

Therefore, it is an object of the present invention to provide a method and an apparatus for displaying characters and/or images to overcome the above problems.

In accordance with one aspect of the present invention, the above and other objects can be accomplished by a provision of a character and/or image display apparatus, comprising a rotary wing assembly consisting of a plurality of light emitting diodes (LEDs) and a rotary wing; a logic control unit controlling the LEDs of the rotary wing assembly to allow the LEDs to display desired characters and/or desired images; a balance unit consisting of a balance plate and a balance weight, the balance unit being assembled with the logic control unit at a position opposite to the rotary wing assembly so as to accomplish a desired balance of the rotary wing assembly regardless of a difference in the center of gravity between the rotary wing assembly and the logic control unit during a rotating action of the rotary wing assembly; a motor unit consisting of a stator, a rotor, a hollow motor shaft having an axial passage and extending through both the stator and the rotor and being connected to both the rotor and the logic control unit at its opposite ends so as to rotate the rotary wing assembly, the logic control unit and the balance unit at the same time by a rotating force of the rotor, and a rotor holder used for locking the logic control unit to the motor shaft; a switch mode power supply (SMPS) used for supplying a direct current (DC) power to the logic control unit in a contactless manner, and mounted to a lower end of the motor shaft so as to be rotatable together with the motor shaft at the same time, the SMPS consisting of a primary board and a secondary board, the primary board transmitting both external alternating current (AC) voltage and external input data to the secondary board, and the secondary board being electrically connected to both the rotary wing assembly and the logic control unit through electric wires passing through the axial passage of the hollow motor shaft, thus transmitting the power and data to both the rotary wing assembly and the logic control unit; a data communication unit consisting of a modem board and an RS-232 board, and being used for transmitting external input data to the logic control unit; a display bulb covering the top of the rotary wing assembly, the logic control unit and the motor unit while forming a sealed space in the bulb, the display bulb allowing a user to observe characters and/or images displayed by the LEDs from the outside of the bulb; and an external casing mounted to a lower end of the display bulb and encasing the motor unit, the SMPS and the data communication unit.

The logic control unit of the present invention may include a micro controller; a backup memory for storing data necessary to the operation of the display apparatus, the backup memory being of a nonvolatile type; a working memory for reading the data stored in the backup memory; a data latch buffer for latching data from the working memory by a predetermined number of vertical dots; a latch clock generator for supplying clock data to the data latch buffer in response to an input/output control signal from the micro controller; an LED data driver for reading data from the data latch buffer in response to the clock data from the latch clock generator; and an LED array for displaying data under control of the LED data driver.

Preferably, the balance between the rotary wing assembly and the logic control unit may be accomplished by adjusting the weight of the balance weight, and the balance weight may be covered with a balance weight cover at its top and bottom, thus being prevented from undesirably coming into contact with the display bulb or from scratching the display bulb during an assembling process of the display apparatus.

Each of the LEDs, preferably, may be free from a flange radially projecting outward from a sidewall of an LED mold of each LED and have one or more LED chips arrayed in one LED mold in a horizontal, vertical, diagonal, or triangular arrangement.

The logic control unit may be covered with a cover at its circular end portion to reduce noises and air resistance during a rotating action of the logic control unit, and the SMPS may be of a flyback type where a secondary side of the SMPS is turned on when a primary side thereof is turned off, and include an AC input unit; a DC converter for converting an AC voltage from the AC input unit into a DC voltage; a pulse width modulation (PWM) control/generation circuit for controlling the output of the DC voltage converted by the DC converter to generate a high voltage; a high voltage/low voltage converter for converting the high voltage from the PWM control/generation circuit into a low voltage; a smoothing circuit for smoothing the low voltage converted by the high voltage/low voltage converter; and an output voltage detector for detecting a voltage signal from the smoothing circuit and transferring the detected voltage signal to the PWM control/generation circuit.

The balance weight may be a screw-type balance weight or a compression-type balance weight.

The motor unit may be an induction motor unit, being rotatable at the same time with the stator and a motor casing of the motor unit being rotatable at the same time while accomplishing a rotational symmetry around the hollow motor shaft.

An electric wire and a data communication wire from the secondary board of the SMPS may pass through the passage of the hollow motor shaft prior to being connected to the logic control unit.

Further, preferably, the secondary board of the SMPS may be provided with a transparent optical sensor unit, the sensor unit being integrally formed with a light emitting part and a light receiving part for sensing both a rotating velocity of the rotor of the motor unit and an initial rotating point of the rotor.

An optical transistor may be mounted to a central position of a ferrite core, the optical transistor being used for optically receiving a variety of data transmitted through a power feedback signal IR (infra-red) of the secondary board of the SMPS or through a power feedback signal IR of the primary board of the SMPS.

The various data may be transmitted from cellular phones, pagers, FM tuners, digital radio systems, RS-232, modems, and keys.

The primary and/or the secondary ferrite core may be EE type formed in the shape of a circle or square.

The primary and/or the secondary ferrite core may form the secondary side of the EE or El core formed in the shape of a circle or square.

The primary and the secondary-side bobbins of the SMPS may be separated from each other, the secondary-side bobbin may be situated inside primary-side bobbin while being upwardly spaced somewhat apart from the primary-side bobbin, and the primary-side bobbin may be mounted to be fixed and the secondary-side bobbin is mounted to be rotated.

The primary and the secondary-side bobbins of the SMPS may be laterally spaced somewhat apart from each other, and the primary-side bobbin of the SMPS may be mounted to be fixed and the secondary-side bobbin of the SMPS may be mounted to be rotated.

The modem board may be connected to external communication means via stereo- or mono-phone jacks, the stereo- or mono-phone jacks being mounted on the inside-support bracket.

In accordance with another aspect of the present invention, there is provided a character and/or image display method comprising the steps of a) applying power to a character and/or image display apparatus and setting up input/output port values and initialization values; b) initializing all LED values and clearing a screen; c) reading initial picture data from a nonvolatile backup memory; d) writing the data read from the backup memory into a working memory; e) reading initialization data from the working memory; f) displaying an initial picture and performing a still mode until a rotation speed of a motor becomes stable; g) reading data other than the initialization data from the working memory; h) sequentially performing modes corresponding to commands contained in the read data; and i) repeating the above steps g) and h) until all commands stored in the working memory are processed.

Preferably, the commands may include a data reception command, a data storage command, a line back & forth command, a frame up command, a frame down command, a reset command and a complex command.

As described above, the method and the apparatus for displaying characters and/or images of this invention has the improved operational effect as follows:

1. This apparatus and method of this invention effectively displays data using bitmap images.

2. In the apparatus and method of this invention, one or three LED chips are mounted to one LED, and so it is possible to increase the number of LED chips mounted within the same area in comparison with conventional apparatuses and methods, thus displaying beautiful characters and/or images in a variety of colors.

3. The logic control unit 200 is covered with a cover 260, and so it is possible to overcome the problem caused by an air resistance and to accomplish a central beam scanning effect.

4. It is possible for the apparatus and method of this invention to accomplish a desired balance of the rotary wing assembly by properly controlling the weight of the balance weight 420.

5. The motor unit is an induction motor unit, with the rotor of the motor unit accomplishing a rotational symmetry around the motor shaft 330. In addition, the motor stator 320 integrated with the motor casing is used as the rotor 310 of the motor, while an armature is used as the motor stator 320. Such an induction motor is remarkably improved in its operational efficiency in comparison with pole shading motors, and has an improved flywheel effect, thus being less likely to be changed in its rotating velocity. In addition, the motor shaft 330 is a hollow shaft defining an axial passage and allowing an electric wire to pass through.

6. In the apparatus of the present invention, the secondary-side power is produced by the SMPS using a feedback signal.

7. In addition, the feedback signal and bitmap image data of the SMPS are transmitted from the center of the ferrite core designed to accomplish a rotational symmetry.

8. In the apparatus and method of the present invention, the ferrite core and bobbin between the primary and secondary boards of the SMPS are locked together while desirably reducing a leakage of current in comparison with the prior art.

9. The secondary board of the SMPS is provided with a transparent optical sensor unit 511, which is integrally formed with a light emitting part and a light receiving part for sensing both the rotating velocity of the motor rotor and the initial rotating point of the rotor. It is thus possible to easily install the sensor unit in the apparatus. The sensor unit is also less likely to be influenced by external noises and has a high response velocity.

10. The apparatus has an expected life span longer than that of conventional apparatuses, and is not likely to be changed in its rotating velocity regardless of a change in load.

11. It is possible for the apparatus of this invention to easily and simply fabricate the circuit of the logic control unit 200 since the apparatus uses the SMPS.

12. The apparatus has a high efficiency, and so it preferably generates a small amount of heat and is less likely to allow a leakage of current, thus being reduced in its power consumption.

13. The apparatus has a high brightness and a high resolution, and so it has a bright and clear display surface.

14. In the apparatus, the motor can be usable semipermanently.

15. Since the apparatus of this invention is preferably reduced in its power consumption, it saves money for power costs.

16. In the apparatus of this invention, a memory, having both the SRAM function and the EEPROM function, is used as the backup memory, and so it is possible for the apparatus to effectively perform a parallel data processing operation. Therefore, the apparatus can quickly process the data without requiring a memory having an enlarged capacity even though it is necessary to process a very large quantity of data.

BRIEF DESCRIPTION OF THE DRAWINGS

The above and other objects, features and other advantages of the present invention will be more clearly understood from the following detailed description taken in conjunction with the accompanying drawings, in which.

MODE FOR CARRYING OUT THE INVENTION

In the present invention, all displayed data are bit map image data, which are displayed in a basic display unit of 24 dots (vertical)×256 dots (horizontal)×1 (color). The present invention is capable of displaying a bit map image up to a display unit of 64 dots×512 dots×3 (full color) or more using a switch mode power supply (SMPS) concept.

Figure 2:
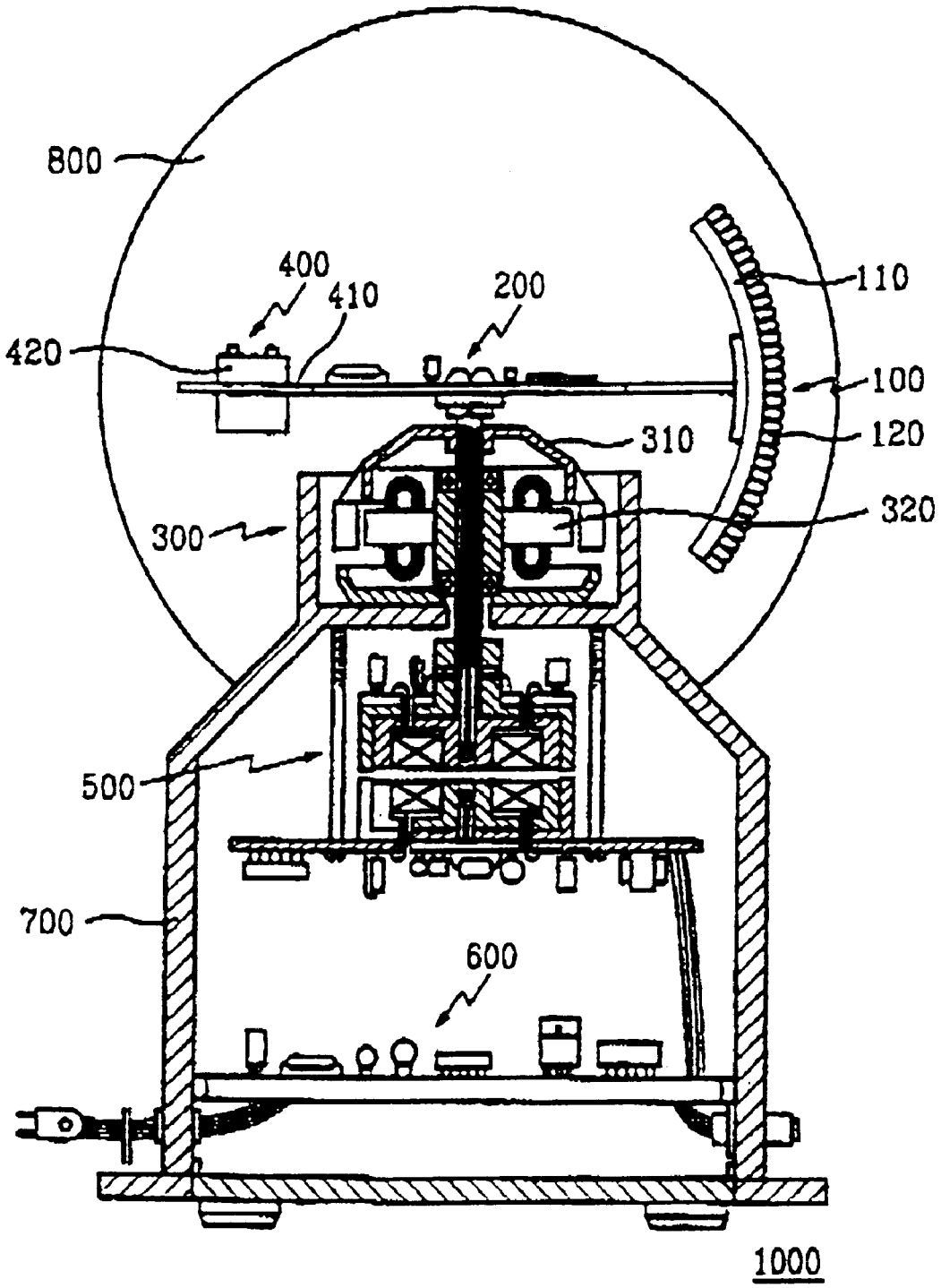
FIG. 2 is a front view of a character and/or image display apparatus in accordance with the preferred embodiment of the present invention.

FIG. 2 is a front view of a character and/or image display apparatus in accordance with the preferred embodiment of the present invention, wherein the apparatus is denoted by the reference numeral 1000. As shown in this drawing, the character and/or image display apparatus 1000 of the present invention comprises a rotary wing assembly 100, logic control unit 200, motor 300, balance unit 400, SMPS 500, data communication unit 600, external casing 700, display bulb 800 and internal support body 900. The constructions and operations of these components will hereinafter be described in detail with reference to the accompanying drawings.

Figure 1:
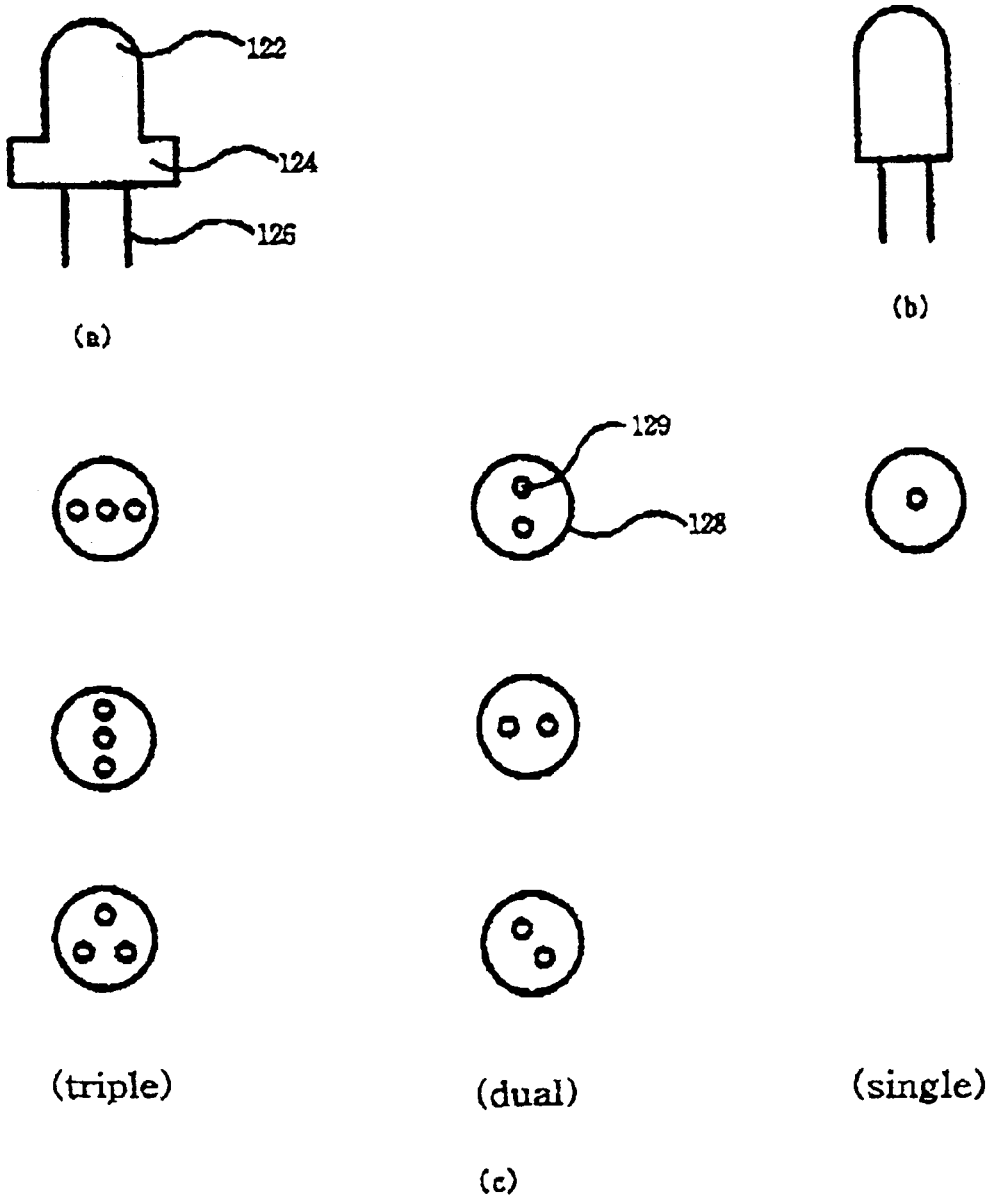
FIG. 1*a* is a front view of a conventional LED.
FIG. 1*b* is a front view of an LED in accordance with the present invention.
FIG. 1*c* is a sectional view of an LED in accordance with the present invention.

FIG. 1*b* is a front view of an LED in accordance with the present invention. In the present invention, the LED 120 has no flange 124, thereby enabling a larger number of LEDs 120 than the prior art to be mounted on the rotary wing assembly 100 of the character and/or image display apparatus 1000 so as to more finely express an image and/or characters. That is, owing to the absence of the flange 124, the adjacent LEDs 120 have a minimum gap therebetween, resulting in an increase in resolution. Preferably, 24 to 64 dots may be vertically realized.

FIG. 1*c* is a sectional view of the LED 120 in accordance with the present invention. In this drawing, a circle indicates an LED mold 128 and a small rectangular portion in the circle indicates an LED chip 129. The LED 120 may basically be classified into three types according to the layout of the LED chip 129. The LED at the right part of FIG. 1*c* is a single LED having only one LED chip 129, each of the LEDs at the center of FIG. 1*c* is a dual LED having two LED chips 129, and each of the LEDs at the left part of FIG. 1*c* is a triple LED having three LED chips 129. Among the triple LEDs, one having the LED chips 129 arranged in the horizontal direction provides a good color mixing effect and another having the LED chips 129 arranged in a regular triangle form provides a good productivity.

The dual and triple LEDs each have LED chips 129 arranged horizontally, vertically, triangularly or diagonally. The LED mold 128 preferably has a diameter of 3 mm or more. Further, the LED 120 can preferably express from a single color up to multiple colors.

Figure 3:
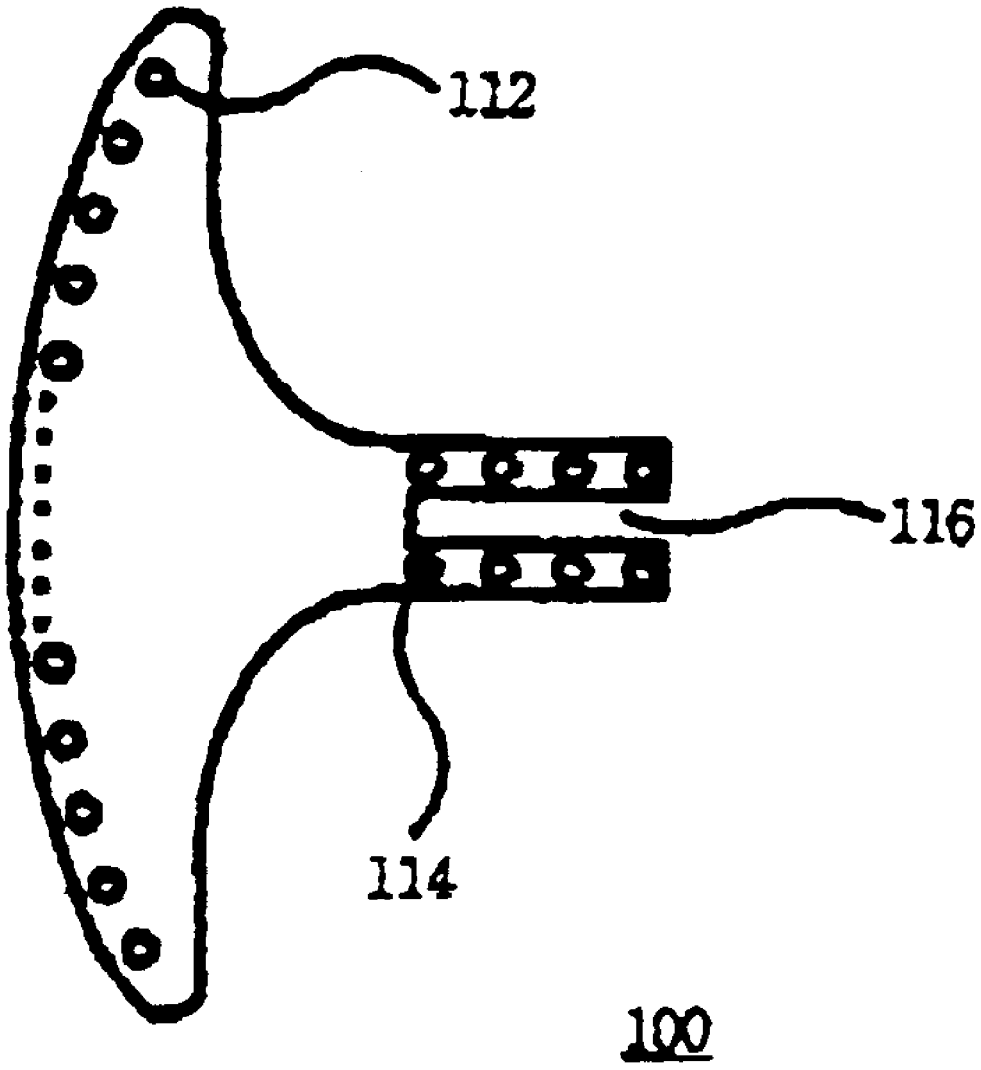
FIG. 3 is a detailed diagram of a rotary wing assembly in accordance with the present invention.
Figure 4:
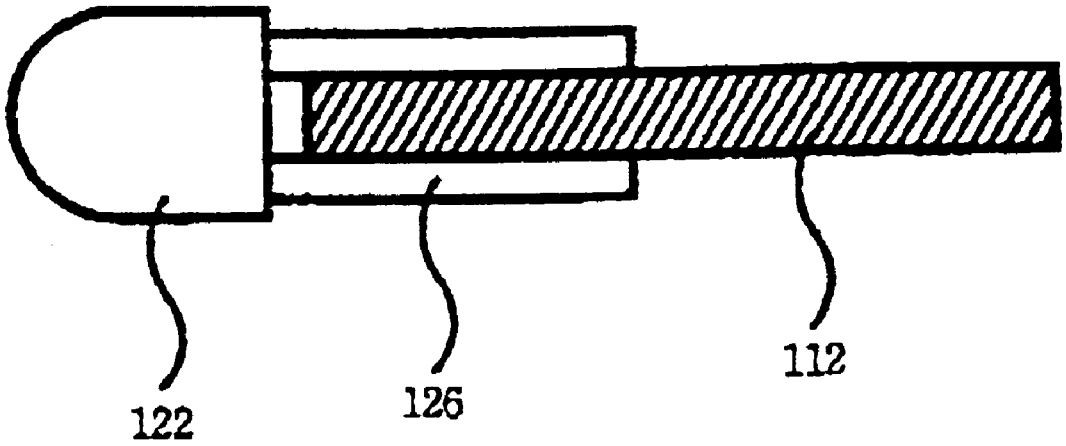
FIG. 4 is a view showing the coupling between an LED and a printed circuit board (PCB) in accordance with the present invention.

FIG. 3 is a detailed diagram of the rotary wing assembly 100 in accordance with the present invention and FIG. 4 is a view showing the coupling between the LED 120 and a pad 112 in accordance with the present invention. As shown in these drawings, the rotary wing assembly 100 basically includes a wing 110, pads 112 and 124 and a groove 116.

In the rotary wing assembly 100, pads 112 are provided at one end of an arrow-shaped wing to fix the LEDs 120 and a groove 116 is formed at the other end of the wing to couple the LEDs 120 with the logic control unit 200. Pads 114 are provided around the groove 116 such that they are coupled with the logic control unit 200.

In the present invention, the logic control unit is designed to have an area as small as possible to minimize an air resistance. Further, the logic control unit is designed to have the same round angle as that of the display bulb 800 to constantly maintain the gap between the ends of the LEDs 120 and the display bulb 800 upon assembling the LEDs 120.

As seen from FIG. 4, a printed circuit board (PCB) pad 112 is inserted between two or more LED legs 126 at one end of the wing 110 of the rotary wing assembly 100 such that it is integrated with the LED legs to fix them. Pads 114 are formed at the other U-shaped end of the wing 110 such that they are coupled with a U-shaped portion of the logic control unit 200 in a + form. The rotary wing assembly 100 may preferably have a four-layered structure. Similarly, the logic control unit 200 may preferably have a four-layered structure.

Figure 5:
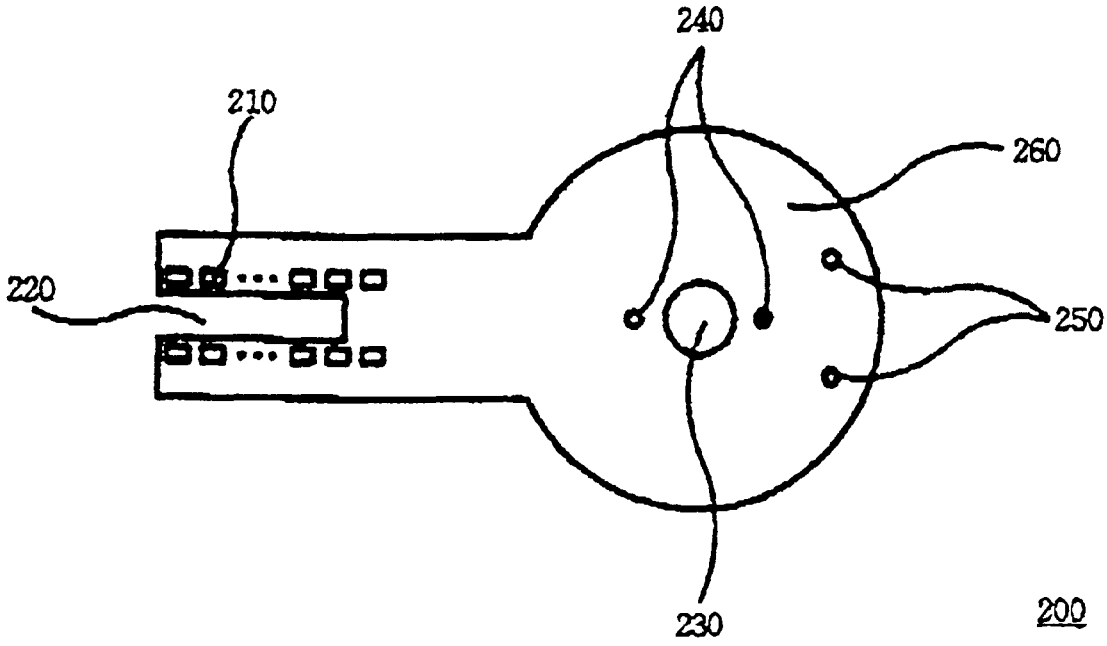
FIGS. 5(*a*) and 5(*b*) are a detailed diagram of a logic control unit in accordance with the present invention.
Figure 5:
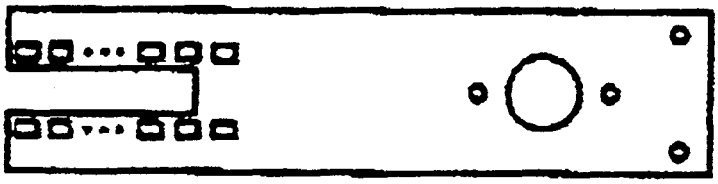

FIGS. 5*a* and 5*b* show different constructions of the logic control unit 200 in accordance with the present invention. The logic control unit 200 includes a controller 260, which may preferably have a circular structure as shown in FIG. 5*a* or a rectangular structure as shown in FIG. 5*b*. A description will hereinafter be given of the logic control unit 200 including the circular controller 260 as an example.

The controller 260 is installed to be symmetrically rotatable about a motor shaft 330. A U-shaped groove 220 is formed in the front portion of the logic control unit 200 such that it is engaged with the groove 116 of the rotary wing assembly 100, and threaded holes 250 are formed in the rear portion of the logic control unit 200 such that they mount a balance plate 410 to the logic control unit 200 therethrough. The balance plate 410 is provided to keep the balance of the display apparatus during its rotation. A plurality of signal connection pads, preferably, twenty-four pads 210 are provided around the groove 220, to which pads of the rotary wing assembly 100 are connected vertically or horizontally.

The logic control unit 200 performs a parallel processing of data to be displayed by LEDs. This unit 200 is inserted into the motor shaft 330 through a hole 230 formed at its center. Threaded holes 240 are formed at the left and right portions of the hole 230 for coupling with a stationary body of a rotor. Connectors are installed on the top of the controller 260 to mount extended boards to the controller 260. A cover 265 is mounted to the logic control unit 200 in consideration of an air resistance. This cover 265 may preferably be of a locker type or a screw type.

Figure 6:
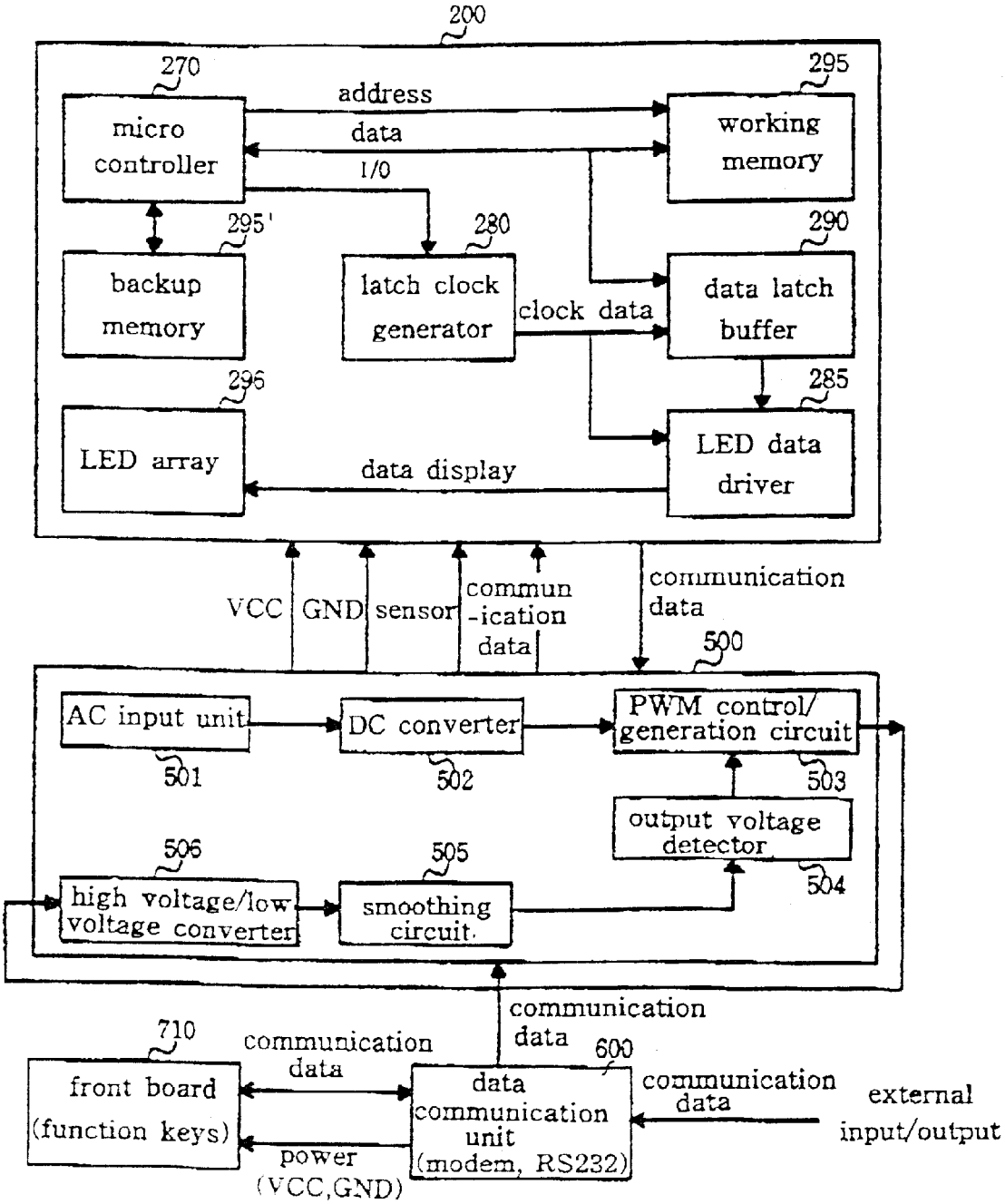
FIG. 6 is a block diagram showing a circuitry of the character and/or image display apparatus in accordance with the preferred embodiment of the present invention.

FIG. 6 is a block diagram showing a circuitry of the character and/or image display apparatus in accordance with the preferred embodiment of the present invention. As shown in this drawing, the character and/or image display apparatus of the present invention comprises a logic control unit 200, SMPS 500, data communication unit 600 and front board 700.

The logic control unit 200 includes a micro controller 270, a backup memory 295' which is a nonvolatile memory for storing data necessary to the operation of the display apparatus, a working memory 295 for reading the data stored in the backup memory 295', a data latch buffer 290 for latching data from the working memory 295 by a predetermined number of vertical dots, a latch clock generator 280 for supplying clock data to the data latch buffer 290 in response to an input/output (I/O) control signal from the micro controller 270, an LED data driver 285 for reading data from the data latch buffer 290 in response to the clock data from the latch clock generator 280, and an LED array 296 for displaying data under control of the LED data driver 285.

In other words, the logic control unit 200 employs one or more central processing units (CPUs) to receive external data and display desired data at a desired position through LEDs. If the logic control unit 200 is powered on, then data to be displayed is transferred from the backup memory 295' to a mapping area of the working memory 295. Then, the data latch buffer 290 latches data from a default bank area of the working memory 295 by a predetermined number of vertical dots (the number of data per line) in response to the clock data from the latch clock generator 280 to display them through LEDs. Thereafter, in response to a data enable clock being toggled, the LED data driver 285 displays the data latched by the data latch buffer 290 through LEDs.

External data and commands are transferred through a serial communication port and stored in the backup memory 295'. Desired data is displayed through LEDs using the data and commands stored in the backup memory 295', as stated above.

The micro controller 270 is operated to display data stored in the working memory 295 through LEDs. The working memory 295 stores all data to be displayed and is one-to-one mapped to the backup memory 295'. In the present embodiment, the working memory 295 may be a static random access memory (SRAM).

The micro controller 270 also acts to control areas (i.e., the backup memory 295' and working memory 295) storing data to be displayed through LEDs. Whereas the micro controller 270 refers to the working memory 295 in operation, it refers to the backup memory 295' upon application of power. Upon application of power, the micro controller 270 transfers data from the backup memory 295' to the working memory 295 and then begins to operate. In the present embodiment, the backup memory 295' may be an EEPROM.

In order to display data stored in the working memory 295 through LEDs, the micro controller 270 can access eight data bits at a time. For this reason, the micro controller 270 must gain access to the working memory 295 four times to drive 32-dot LEDs. At this time, respective data access time points are different, resulting in the same line being misaligned on a 8-dot basis. For the purpose of preventing this problem, the data latch buffer 290 has a two-stage structure. Namely, the data latch buffer 290 performs its original data latch function at the first stage and a one-line simultaneous active function at the second stage, respectively. Alternatively, the data latch buffer 290 may perform only the first stage function. In this case, the LED data driver 285 may perform the second-stage function.

The latch clock generator 280 is adapted to generate a control signal to latch or enable data in the data latch buffer 290 and LED data driver 285 when the micro controller 270 accesses data stored in the working memory 295 to display it through LEDs.

The LED array 296 is an LED display module which is capable of expressing data to be displayed by the micro controller 270 in the form of light beams.

Now, a more detailed description will be given of the operation of the character and/or image display apparatus with the above-mentioned construction in accordance with the present invention. The present invention is characterized in that desired data is displayed at a desired position using a man's optical illusion phenomenon occurring with rotation of a vertical array of LEDs at a speed of about 3600 rpm.

For a rotation speed of 3600 rpm, a time period of 16.67 msec is required per one rotation. The length of the logic control unit 200 is 14.3 cm, which is a radius of rotation. The resulting circumferential locus is 89.45 cm.

For 32 3 mm-sized LEDs arrayed, the size of a vertical display area is 96 mm for single-color expression. For 24 4 mm-sized LEDs arrayed, the size of a vertical display area is similarly 96 mm for multicolor expression.

The size of a horizontal display area is 913 mm for 256 dots. In the case where 32×32 fonts are displayed in a square form, the size of a vertical display area becomes 96 mm and the number of displayable fonts becomes 9.5 characters. In this case, the size of a horizontal display area becomes 330 dots.

Because a time period of 65.2 $\mu$sec is required to display one line in the vertical direction, a horizontal dot interval becomes 3.57 mm.

The size of data per frame is 1024 bytes for single-color expression and 3072 bytes for three-color expression. A memory size is 32 Kbytes. The total number of frames is 32 for single-color expression and 10.7 for three-color expression.

On the other hand, the SMPS 500 of the present invention is an ON/OFF-type SMPS, which is also of a flyback type wherein a secondary side of the SMPS 500 is turned on when a primary side thereof is turned off. The SMPS 500 includes an AC input unit 501, a DC converter 502 for converting an AC voltage from the AC input unit 501 into a DC voltage, a pulse width modulation (PWM) control/generation circuit 503 for controlling the output of the DC voltage converted by the DC converter 502 to generate a high voltage, a high voltage/low voltage converter 506 for converting the high voltage from the PWM control/generation circuit 503 into a low voltage, a smoothing circuit 505 for smoothing the low voltage converted by the high voltage/low voltage converter 506, and an output voltage detector 504 for detecting a voltage signal from the smoothing circuit 505 and transferring the detected voltage signal to the PWM control/generation circuit 503. Here, the AC input unit 501, DC converter 502, PWM control/generation circuit 503 and high voltage/low voltage converter 506 are provided at the primary side of the SMPS 500 and the smoothing circuit 505 and output voltage detector 504 are provided at the secondary side of the SMPS 500.

All communication data and sensor signal outputs from the SMPS 500 are inputted to the micro controller 270 in the logic control unit 200. Also, all communication data outputs from the logic control unit 200 to the SMPS 500 originate from the micro controller 270.

If an AC voltage is inputted by the AC input unit 501, then it is converted by the DC converter 502 into a DC primary voltage with a magnitude higher than the input voltage by 2 times. This converted DC voltage is applied to the PWM control/generation circuit 503. The output voltage detector 504 detects an output voltage from the smoothing circuit 505 and outputs a low signal to the PWM control/generation circuit 503 if the detected voltage is lower than a reference voltage (5.0 to 5.3V). In response to the low signal from the output voltage detector 504, the PWM control/generation circuit 503 increases a duty ratio of its output voltage. In the opposite case to the above, the PWM control/generation circuit 503 reduces the duty ratio of its output voltage through the same path as the above.

The high voltage/low voltage converter 506 is a kind of transformer, which induces a low voltage in its secondary coil in response to a high voltage in its primary coil. This induced AC voltage is converted into a DC voltage by removing a negative voltage component therefrom. This converted DC voltage contains a ripple component, which is then removed by the smoothing circuit 505. As a result, a voltage of 5V is supplied to the logic control unit 200.

The output voltage detector 504 transfers the state of an output voltage from the smoothing circuit 505 to the PWM control/generation circuit 503. In the case where the output voltage from the smoothing circuit 505 is lower in level, an infrared (IR) beam from the output voltage detector 504 is lower in intensity, too, and a phototransistor is increased in discharging time. At this time, the PWM control/generation circuit 503 senses the amount of collector-emitter current of the phototransistor and increases the duty ratio of its output voltage and, thus, its level as a result of the sensing.

The data communication unit 600 includes a transmitter and a receiver. The transmitter converts data of an RS-232C level from a PC into a TTL level and transmits it to the front board 710. The transmitter receives commands and modem data of the TTL level processed by the front board 710 and converts them into the RS-232C level for the driving of an IR beam.

The IR beam driven in the transmitter is received by the receiver through the phototransistor. This received signal contains a large amount of noise. As a result, the received signal is noise-removed and then transferred to the logic control unit 200.

Figure 7:
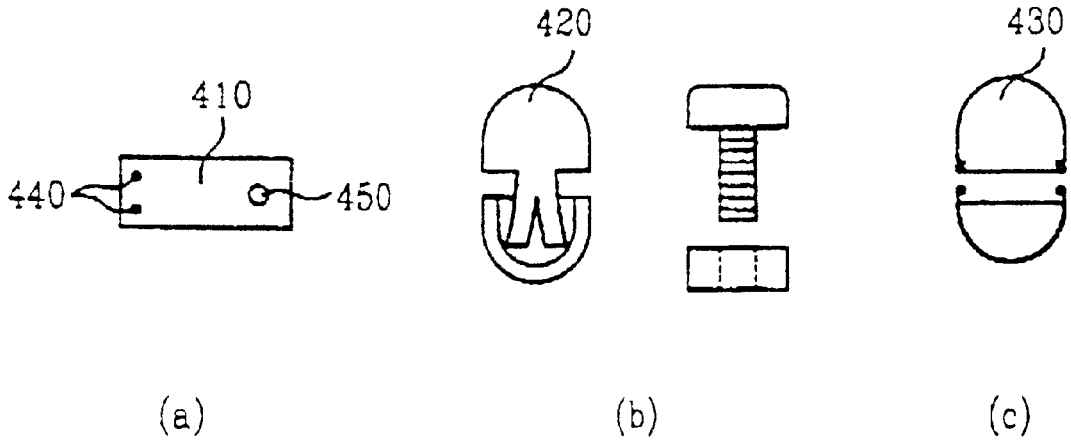
FIGS. 7(*a*), 7(*b*) and 7(*c*) are a view showing the constructions of a balance plate, balance weight and balance weight cover in accordance with the present invention.

FIG. 7*a* shows a balance plate 410, FIG. 7*b* shows two balance weights 420, and FIG. 7*c* shows a balance weight cover 430. In the present invention, it is preferred to make the balance plate 410, the balance weights 420 and the balance weight cover 430 using an elastic metal or a plastic material having high elasticity. The balance unit 400 comprises the balance plate 410, the balance weights 420, and the balance weight cover 430 covering the top and bottom of the balance weights 420. The above balance weight cover 430 is used for preventing the balance weights 420 from undesirably coming into contact with the display bulb 800 during an assembling process of the display apparatus 1000 thus preventing the surface of the bulb 800 from being scratched. In FIG. 7(*b*), a screw-type balance weight is shown at the right side of the drawing, while a compression-type balance weight is shown at the left side.

Two first holes 440 are formed at one end portion of the balance plate 410 for locking the logic control unit 200 to the plate 410, while one second hole 450 is formed at the other end portion of the plate 410 for locking the weight 420 made of steel, lead or rubber to the plate 410. The cover 430 covers the top and bottom of the balance plate 410. The above balance unit 400 is used for accomplishing a desired balance of the rotary wing assembly 100 regardless of a difference in the center of gravity between the wing assembly 100 and the logic control unit 200 during a rotating action of the wing assembly 100.

Figure 8:
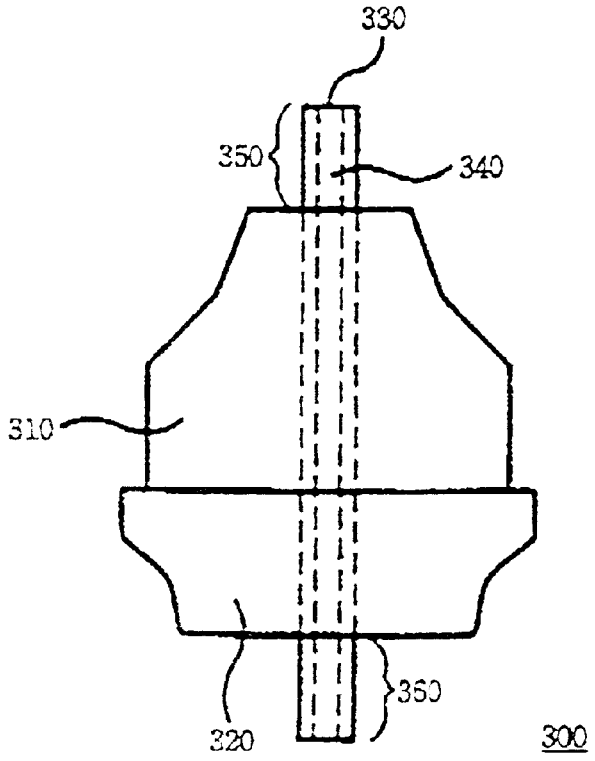
FIG. 8 is a view showing the construction of a motor in accordance with the present invention.

FIG. 8 shows the motor unit 300. As shown in the drawing, the motor unit 300 is an induction motor, of which the stator 320 is designed to be rotatable. This motor unit 300 consists of a rotor 310, a stator 320, a hollow motor shaft 330, a longitudinal passage 340, a fixed mount 360 and a logic control mount 350. The above passage 340 is longitudinally formed along the central axis of the motor shaft 330. The fixed mount 360 is used for mounting the secondary board of the SMPS (switch mode power supply).using a secondary-side fixing holder. The logic control mount 350 is used for mounting the logic control unit 200 using a rotor-fixing holder (not shown).

The above rotor-fixing holder is firmly fixed to a shaft insert hole of the motor shaft 330, and has first and second screw holes. In such a case, the first screw hole of the rotor-fixing holder fixes and holds the logic control unit 200 during a rotating action of the unit 200 while maintaining a desired balance of the unit 200 without allowing the unit 200 to be undesirably moved. The second screw hole is used for mounting the rotor-fixing holder to the motor shaft 330. The above rotor-fixing holder accomplishes a rotational symmetry around the motor unit 300.

A plurality of heat dissipating holes are formed on the external surface of the rotor 310, while a support connector is provided on the stator 320 for firmly connecting the ground terminal connector to the first board of the primary board of the SMPS.

The motor shaft 330 is connected to the rotor 310, with the passage 340 formed along the central axis of the shaft 330. An electric wire and data communication wire from the secondary board of the SMPS pass through the passage 340 of the motor shaft 330 prior to being connected to the logic control unit 200, thus supplying electric power and transmitting data from the SMPS to the logic control unit 200.

The logic control unit 200 and the secondary board of the SMPS are connected to the upper and lower ends of the motor shaft 330, and so the rotor 310 together with the motor shaft 330 is rotated when the motor unit 300 is activated. Due to the rotating action of the motor shaft 330, the other parts of the motor unit 300 are rotated by the rotating force of the motor shaft 330 at the same time.

The motor used in the display apparatus of this invention is an induction motor, with an armature used as a stator, and a stator used as a rotor. Such an induction motor is complex in its construction and is difficult in its fabricating process in comparison with a pole shading motor. However, the induction motor preferably has a high efficiency, and so it desirably generates a small quantity of heat. Since the induction motor also uses a heavy stator as its rotor, the motor is less likely to be markedly changed in its rotating velocity, regardless of an air resistance or its own weight, once the motor reaches a predetermined final rotating velocity. In addition, the motor unit 300 of this invention is designed to allow the stator to be rotatable together with the external casing of the motor unit at the same time, and so the weight of the rotor is increased to the maximum. Therefore, the rotor is improved in its flywheel effect. The rotating velocity of the rotor is thus less likely to be influenced by an air resistance or its own weight.

Figure 9:
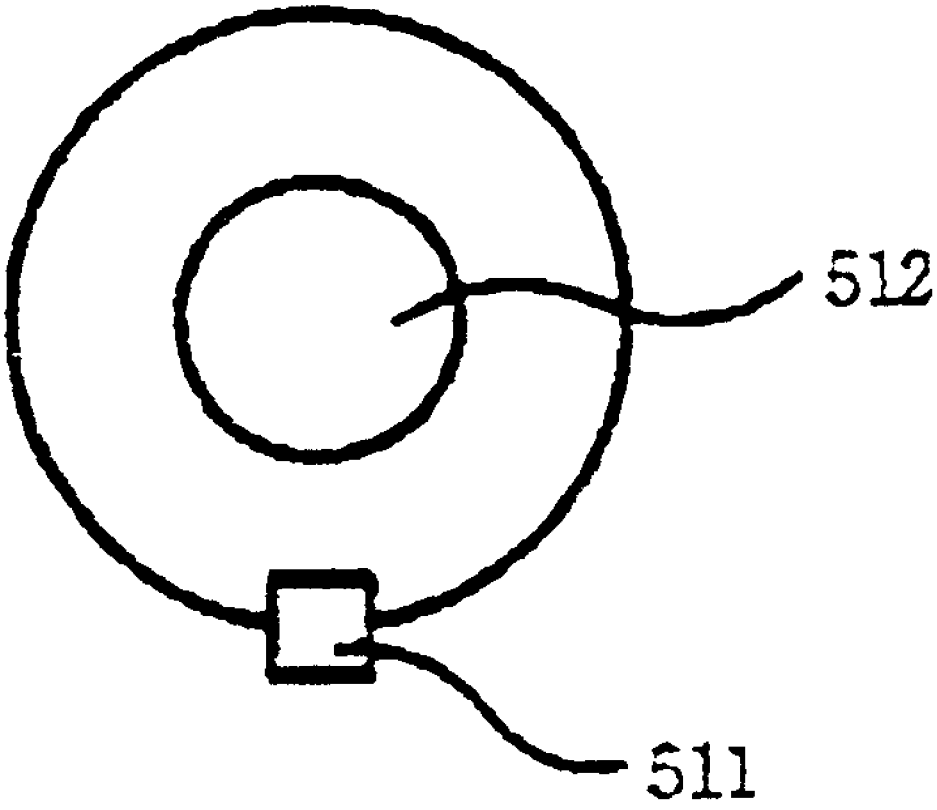
FIG. 9 is a view showing the construction of a secondary board of a switch mode power supply (SMPS) in accordance with the present invention.
Figure 10:
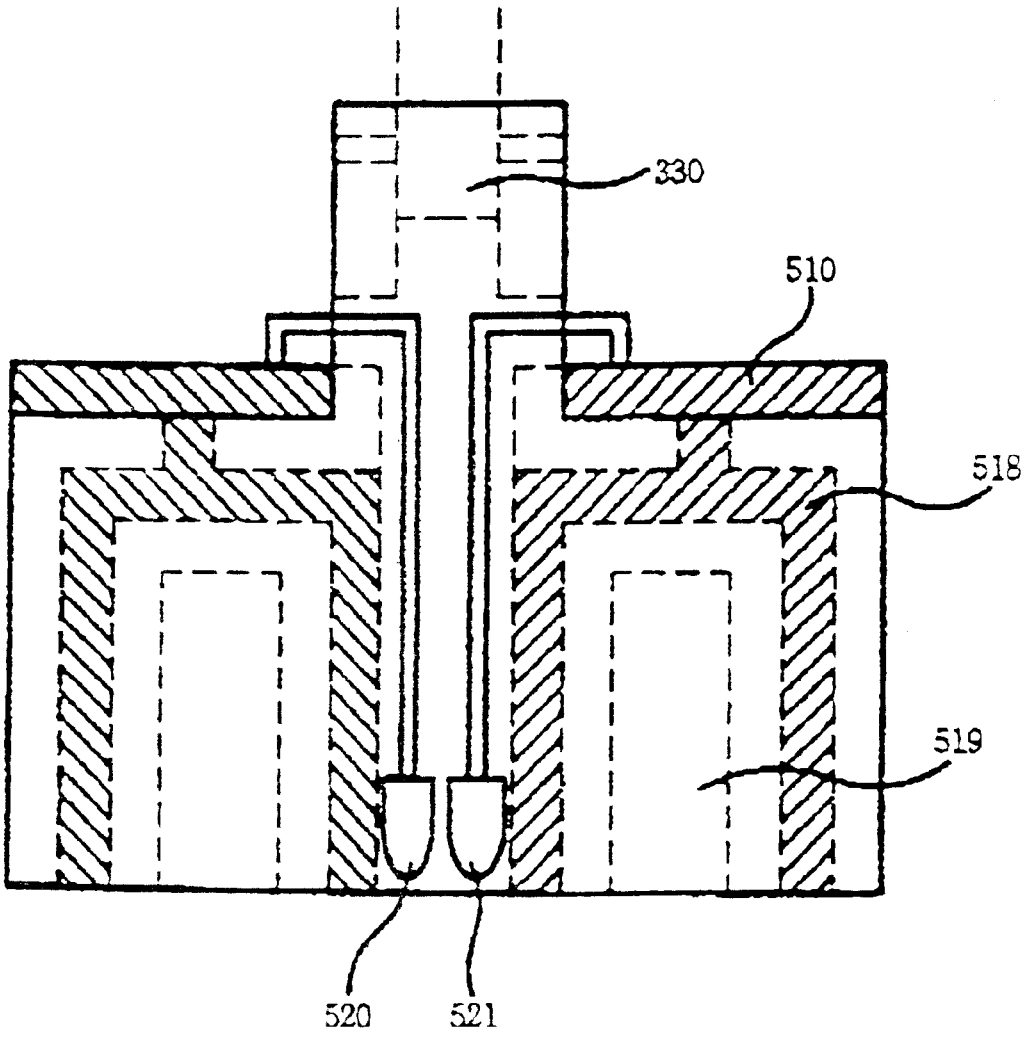
FIG. 10 is a detailed diagram of the secondary board of the SMPS in FIG. 9.

FIG. 9 shows the secondary board of the SMPS, FIG. 10 shows the construction of the secondary board of FIG. 9 in detail. As shown in the drawings, the secondary board 510 of the SMPS generally comprises a motor shaft holding unit 512, a transparent optical sensor unit 511, and an element mount unit. The motor shaft holding unit 512 receives the motor shaft 330, thus holding the shaft 330, while the transparent optical sensor unit 511 senses both the rotating velocity of the rotor 310 of the motor unit 300 and the initial point of the rotating rotor 310. On the other hand, the element mount unit is used for mounting and holding the elements of the secondary board 510 of the SMPS.

In the present invention, the secondary board 510 of the SMPS is a printed circuit board (PCB) having a rectangular or circular profile, and is mounted to the motor shaft 330 while accomplishing a rotational symmetry around the shaft 330. In the present invention, the PCB used as the secondary board 510 of the SMPS may be directly mounted to the motor shaft 330. Alternatively, the PCB used as the secondary board 510 may be indirectly mounted to the shaft 330 using a separate holder or an adhesive agent. In addition, a ferrite core is mounted to the motor shaft in the same manner as that described for the PCB of the secondary board 510.

Figure 11:
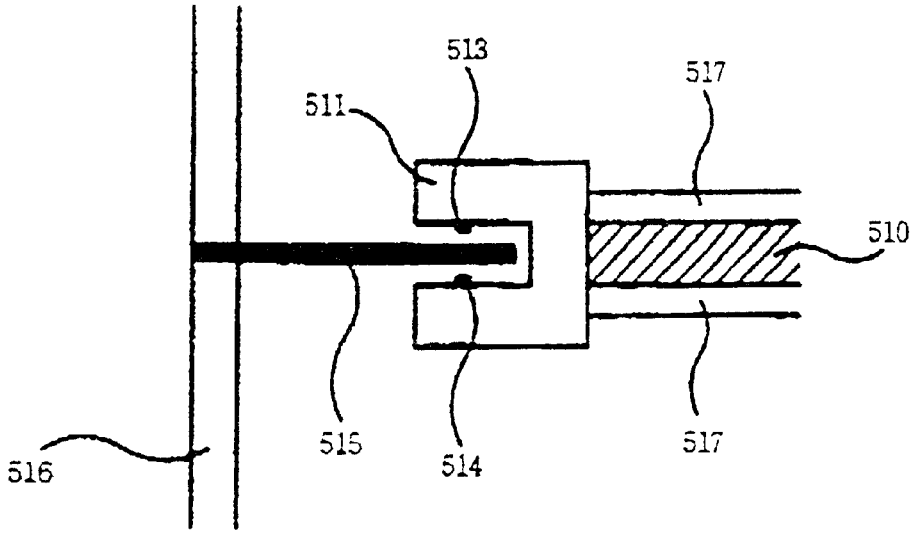
FIG. 11 is a view showing a layout of a transmission-type optical sensor in accordance with the present invention.

FIG. 11 shows the transparent optical sensor unit 511 of the secondary board 510 of the SMPS. As shown in the drawing, the optical sensor unit 511 may be freely positioned on the secondary board 510 of the SMPS at any desired position in accordance with the position of a point designation tag 515 of the primary-size fixing holder 516 mounted to the stator 320 of the motor unit 300. The above optical sensor unit 511 is a single body having a light emitting part 513 and a light receiving part 514, with four lead wires 517 extending from one end of the sensor unit 511 and the secondary board 510 of the SMPS engaging with the lead wires 517.

The above optical sensor unit 511 is fixed to the motor shaft 330 while being positioned on the secondary board 510 of the SMPS, and so the sensor unit 511 is rotatable together with the motor rotor 310. This optical sensor unit 511 senses the point designation tag 515 of the stator 320 during a rotating action of the rotor 310.

An optical transistor 521 is mounted to the central position of the ferrite core 518. This optical transistor 521 optically receives a variety of data, such as digital data transmitted from cellular phones, pager phones, FM tuners, digital radio systems, RS-232, modems, or keys through the power feedback signal IR (infra-red) 520 of the secondary board 510 of the SMPS or through the power feedback signal IR of the primary board 530 of the SMPS. The above-mentioned parts are assembled with the second board 510 of the SMPS. In addition, the terminals of the bobbins 519 assembled with the ferrite cores 518 are connected to the secondary board 510 of the SMPS.

Although not illustrated in the drawings, the combination of the secondary-side ferrite core of the SMPS and the bobbin holder includes a motor shaft fitted portion, an electric wire connector portion, a ferrite core and a bobbin connector portion.

The bobbin holder is secured to the motor shaft 330. The bobbin holder fixes the ferrite core connected with the secondary-side bobbin in its lower portion, and accommodates an IR 520 and a phototransistor 521 in its center portion. A secondary board 510 of the SMPS is mounted to the upper portion of the bobbin holder.

Accordingly, the secondary-side ferrite core of the SMPS and the bobbin holder allows the secondary board of the SMPS to be secured to the motor shaft 330, and serves to cause the secondary board of the SMPS to be rotated together with the motor rotor 310 while the motor is rotated. The secondary-side ferrite core forms the secondary side of an EE or EI type core formed in the shape of a circle or square, and is made of power transmitting material. The combination of the secondary ferrite core of the SMPS and the bobbin holder form the secondary side of the SMPS along with the secondary board 510 of the SMPS, and is rotated.

The IR 520 and the phototransistor 521 of the secondary-side of the SMPS serve to transmit digital data, such as a power feedback signal, bitmap per frame image data and command data of the secondary-side board of the SMPS, and are mounted in the central cavity of the ferrite core by means of a holder.

Figure 12:
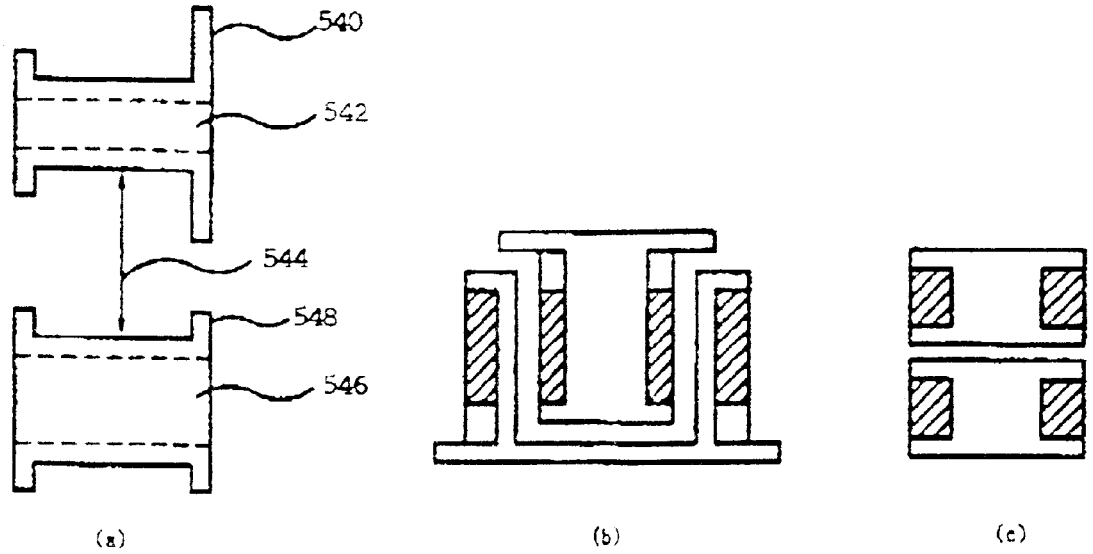
FIGS. 12(*a*), 12(*b*) and 12(*c*) are a view showing constructions of primary and secondary bobbins of the SMPS in accordance with the present invention.

FIG. 12 is view showing the primary-side and secondary-side bobbins in accordance with the present invention. In FIG. 12*a*, the secondary-side bobbin 540 of the SMPS is illustrated on the upper portion of the drawing, and the primary-side bobbin 548 is illustrated on the lower portion. A space in which coils are wound is provided between the primary-side and secondary-side bobbins 540 and 548. Two ferrite core holes 542 and 546 are formed through the primary-side bobbin 540 and the secondary-side bobbin 548, respectively.

The primary-side bobbin 540 and the secondary-side bobbin 548 are separated from each other. Accordingly, the secondary-side bobbin 540 is fixedly fitted around the secondary-side ferrite core and mounted by means of a holder, and the primary-side bobbin 548 is fitted around the primary-side ferrite core and mounted by means of a holder. Two manners of connecting the primary-side bobbin 548 and the secondary-side bobbin 540 exist, as shown in FIGS. 12*b* and 12*c*.

In accordance with a first manner, the secondary-side bobbin 540 is situated inside and overlapped with the primary-side bobbin 548 while being upwardly spaced somewhat apart from the primary-side bobbin 548, the primary-side bobbin 548 is mounted to be fixed, and the secondary-side bobbin 540 is mounted to be rotated.

In accordance with a second manner, the secondary-side bobbin 540 is situated beside the primary-side bobbin 548 while being laterally spaced somewhat apart from the primary-side bobbin 548, the primary-side bobbin 548 is mounted to be fixed, and the secondary-side bobbin 540 is mounted to be rotated.

Figure 13:
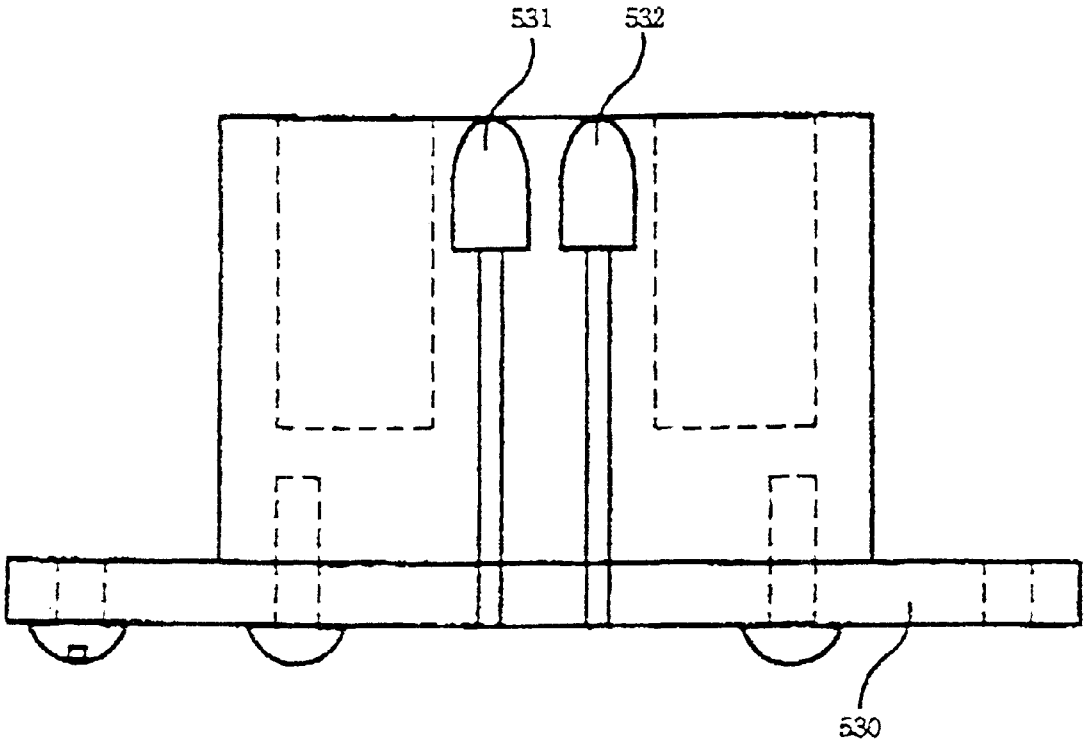
FIG. 13 is a view showing the construction of a first board of a primary board of the SMPS in accordance with the present invention.

FIG. 13 is a partial cross-section showing the primary board 530 of the SMPS. The board 530 serves to fixedly connect the primary ferrite core of the SMPS and the bobbin-fixing portion to each other, has a square or circular shape, and forms the primary side of the SMPS. Additionally, the board 530 has a pad to which the three pins of the AC input terminal of the motor are connected.

Figure 14:
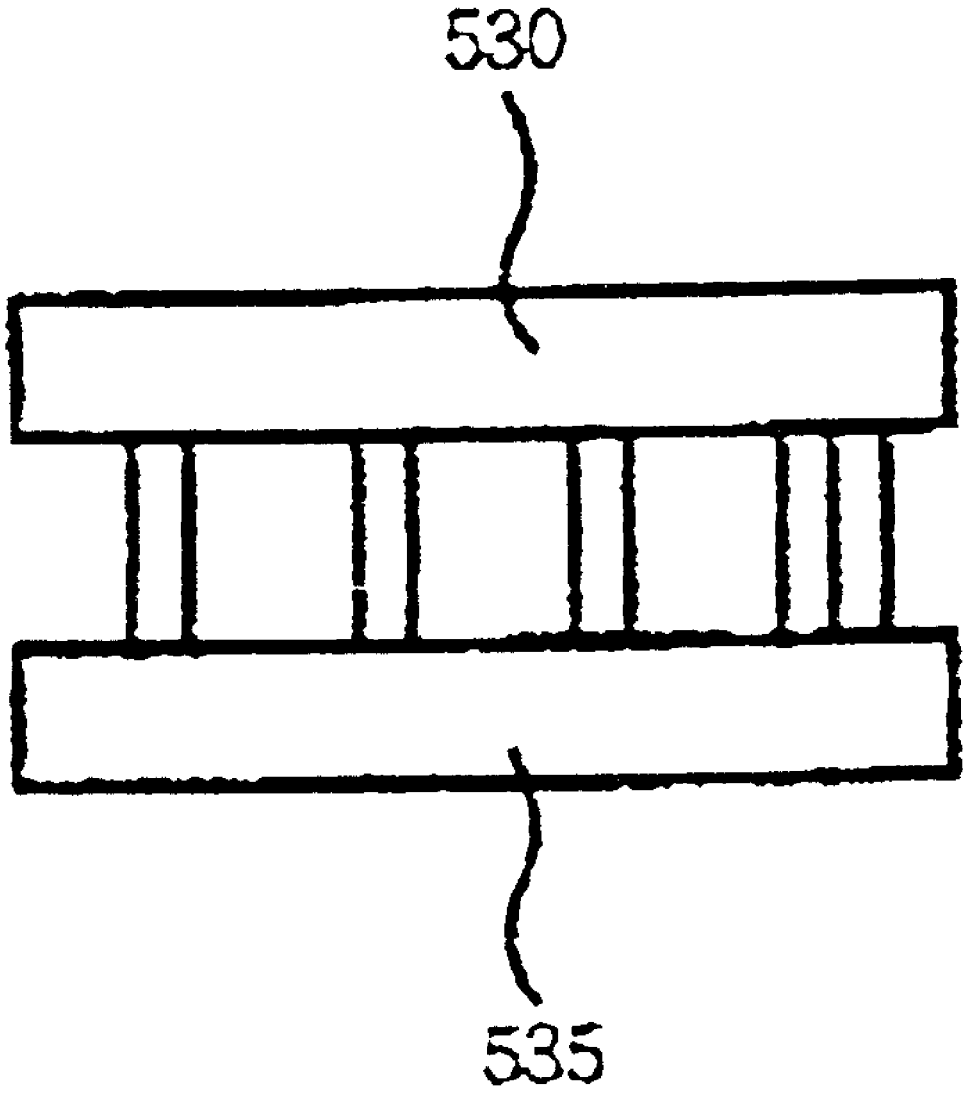
FIG. 14 is a view showing the coupling between the first board of the primary board of the SMPS and a second board thereof in accordance with the present invention.

As depicted in FIG. 14, the first board 530 of the primary side of the SMPS 530 is connected with the second board 535 of the primary side of the SMPS through a connector 536, thus forming the primary side of the SMPS. The ferrite core and the bobbin are fixed by means of a holder. An IR 531 and a phototransistor 532 held by a holder in the cavity situated in the center portion of the ferrite core are connected to these portions. Although not illustrated in the drawings, this is fixedly connected to the stator 320 of a motor by means of a support.

In constructing the SMPS, the second board 535 of the primary side of the SMPS is a portion in which the remaining portion excepting portions ranging from an AC input to the connecting portion of the primary and secondary ferrites is mounted. The second board 535 of the primary side of the SMPS is connected to the first board 530 of the primary side of the SMPS to form the primary side of the SMPS, and transmits AC power input from the outside and digital data, such as bitmap image data and various command data input through external apparatus (such as a cellular phone, a radio pager, a FM tuner, a digital radio system, a remote controller or the like), to the secondary board 510 of the SMPS through the first board 530 of the primary side of the SMPS.

The IR 531 and phototransistor 532 of the primary side of the SMPS transmit data or a power feedback signal to and receive data or a power feedback signal from the IR 520 and phototransistor 521 of the secondary side of the SMPS, and are capable of transmitting and receiving data while being rotated. The IR 531 and phototransistor 532 of the primary side of the SMPS are mounted to a fixing holder for the ferrite core of the primary side of the SMPS and the bobbin-fixing portion.

The data communication unit 600 includes a modem board 610 and a RS232 board 620. The modem board 610 is formed in the shape of a square or circle, and satisfies Modem Protocol Standard VIS.22. The modem board 610 supports basic modem protocol. The modem board 610 is connected to the second board 535 of the secondary side of the SMPS through a pin connector or wire.

As usual, the connection of a modem board 610 to external communication means is achieved by use of stereo- or mono-phone jacks, which are mounted on the inside-support bracket 900. In this regard, the inside-support bracket 900 comprises a casing and an additional support body. Thus, external RS-232 data and model data are inputted through the stereo- or mono-phone jacks and outputted toward the telephone via telephone jacks.

The front board 710 (not shown), installed in the external casing 700, has the function of multiplexing RS-232 data, modem data and/or key data through IC chips or analog switches or the like. In addition to being associated with key switches, the front board 710 is combined directly or via a wire to the modem board 610 for inputting and outputting data.

Figure 15:
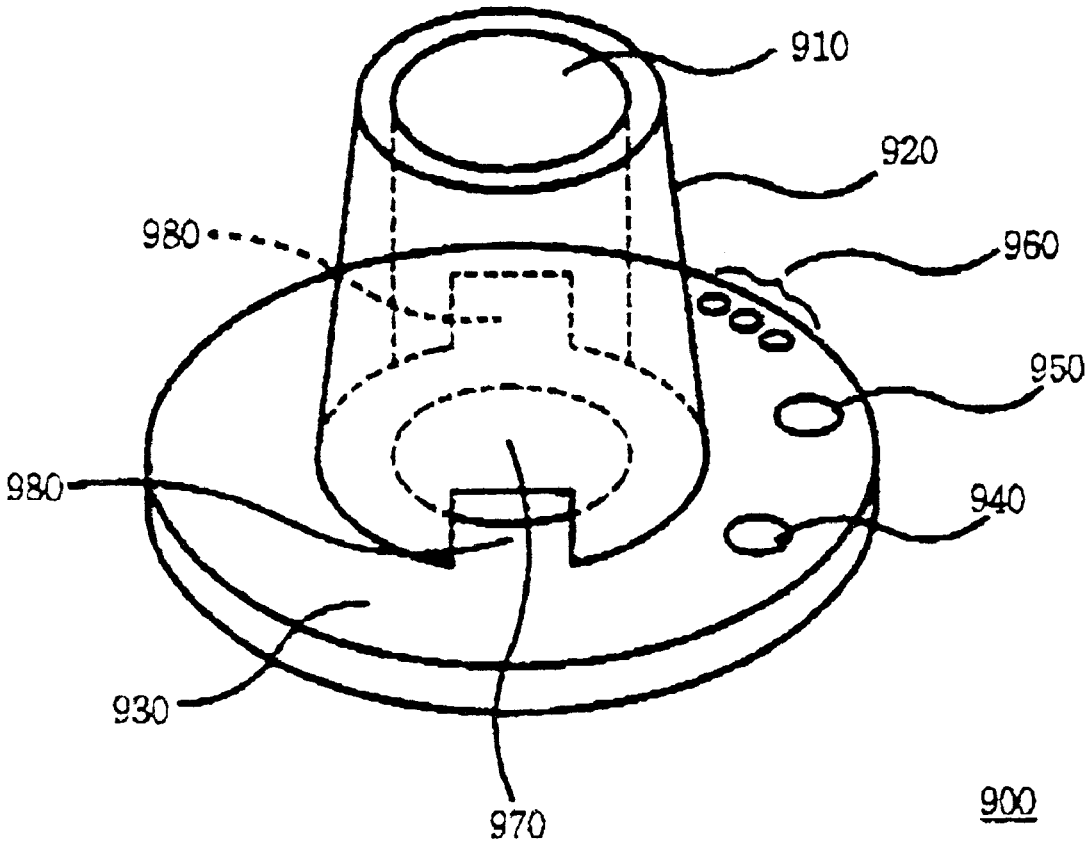
FIG. 15 is a view showing the construction of an internal support body in accordance with the present invention.

Turning now to FIG. 15, there is shown an inside-support bracket 900. This inside-support bracket 900 can be largely separated into an upper cylindrical member 920 and a lower disk member 930. In the center of the cylindrical member 920, a cavity 910 is provided for seating a motor. Facing each other, a pair of opposite grooves 980 for combining with the modem board 610 are set in the bottom of the upper member 920, at which the lower member 930 is contacted with the upper member 920.

On one side of the upper surface of the lower member 930, a fuse holder 940, an AC cord 950 and a plurality of connectors 960 for interfacing with external apparatuses lie adjacent to each other. Directed downwardly, a draft hole is provided in the center of the lower member 930.

Preferably, the inside-support bracket 900 is made of iron, aluminum, plastic or the like. With the structure, the inside-support bracket 900 is associated with a motor stator 320 at the cavity 910, with external apparatuses at the connectors 960, and with the modem board 610 at the opposite grooves 980. Also, wires can be connected to the inside-support bracket 900. The cavity 910 in the center of the upper member 920 also accommodates an SMPS.

Installed in the inside-support bracket 900 are connectors, AC input cords, and fuse holders, said connectors connecting to connecting terminals of external communication means with the aim of transferring bitmap image data from and to RS-232 ports or modems of PC or external communication means (cellular phones, pagers, FM tuners, digital radio systems, etc). The inside-support bracket 900 is rotationally symmetrical on a motor shaft 330.

The external casing 700 has a neck of a pinched, rectangular or trapezoidal shape, which is equipped with key buttons, a power on/off switch and function key switches. In an upper part of the external casing 700 is provided an assembling means through which the display bulb 800 is associated with the external casing 700 while the lower part of the external casing 700 is structured to combine with the inside-support bracket 900.

Preferably made of colored polycarbonate or acryl, the display bulb 800 has a neck provided with several thread grooves at its lower part. The display bulb 800 is combined with the external casing 700 by rotationally fitting the neck into the assembling means of the external casing and fixing by use of screw spikes.

In the present invention, a Windows font is used to display characters and a picture board in the MS Windows 95 version or later is used to create data. Further, a bit map is used to display a desired image.

The logic control unit 200 contains a software module for displaying a variety of bit map image data through LEDs using a CPU or microcomputer.

The modem board 610 is adapted to receive modem protocol data or RS232C level data transmitted through an external telephone line using the CPU or microcomputer, convert the received data into bit map image data processible in the logic control unit 200 and transfers the converted bit map image data to the logic control unit 200. The data communication unit 600 is adapted to communicate with the front board 710 having function keys.

In the present invention, the contactless-type SMPS is used to transfer electrical energy. The use of the contactless-type SMPS can reduce the amount of noise as compared with a conventional brush-type product or generator-type product.

The SMPS employs a ferrite core and bobbin, thereby causing a secondary voltage to be generated under the condition of no rotation and the rotation speed not to vary due to the amount of load on the secondary side. Further, as compared with the prior art, the circuitry is highly stable and the amount of voltage ripple is small.

Figure 18:
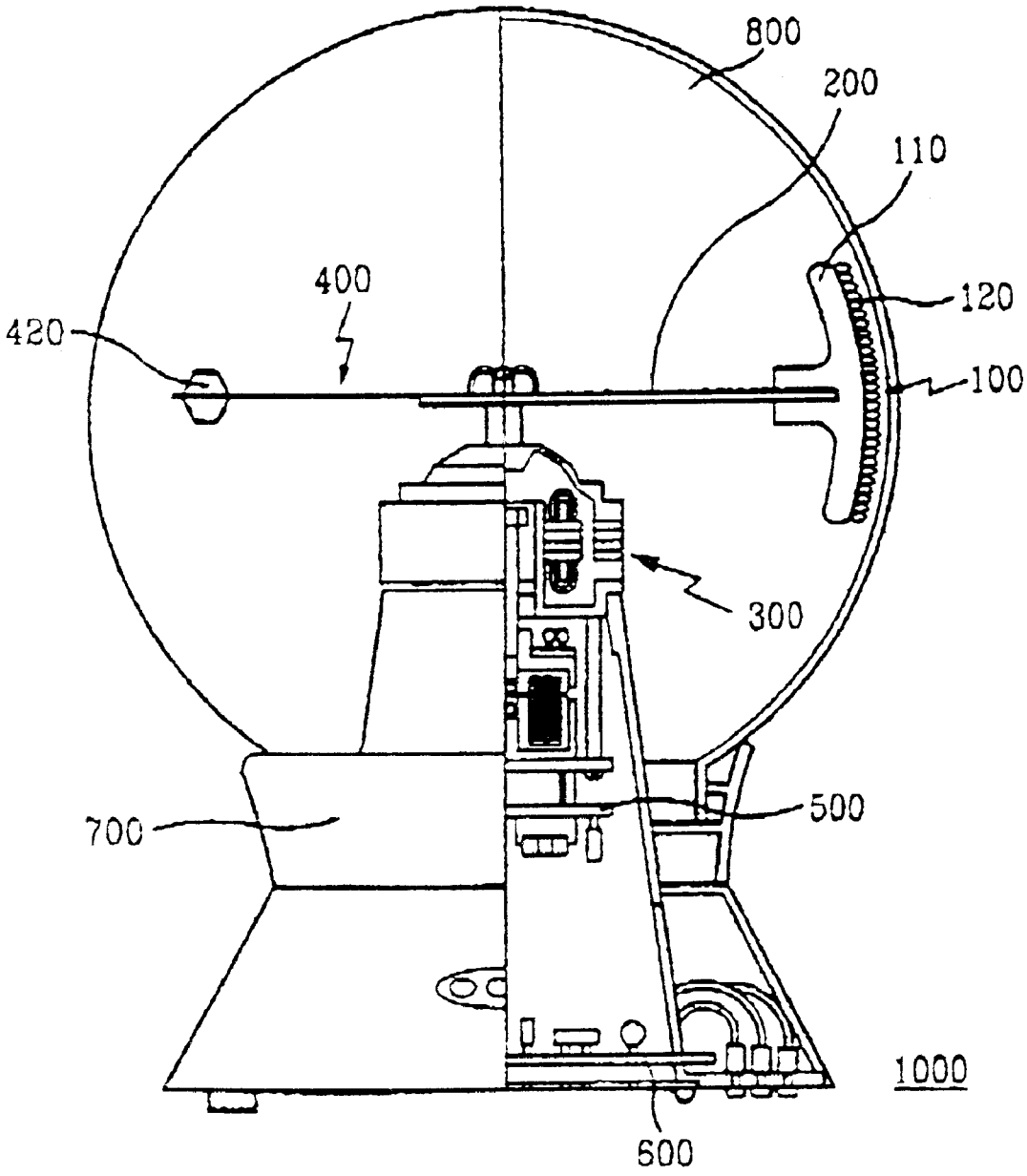
FIG. 18 is a front view of a character and/or image display apparatus in accordance with an alternative embodiment of the present invention.

FIG. 18 is a front view of a character and/or image display apparatus in accordance with an alternative embodiment of the present invention. This second embodiment is substantially the same in construction and operation as the first embodiment, with the exception that the external casing 700, balance weight 420 and rotary wing assembly 100 have modified shapes.

Figure 16:
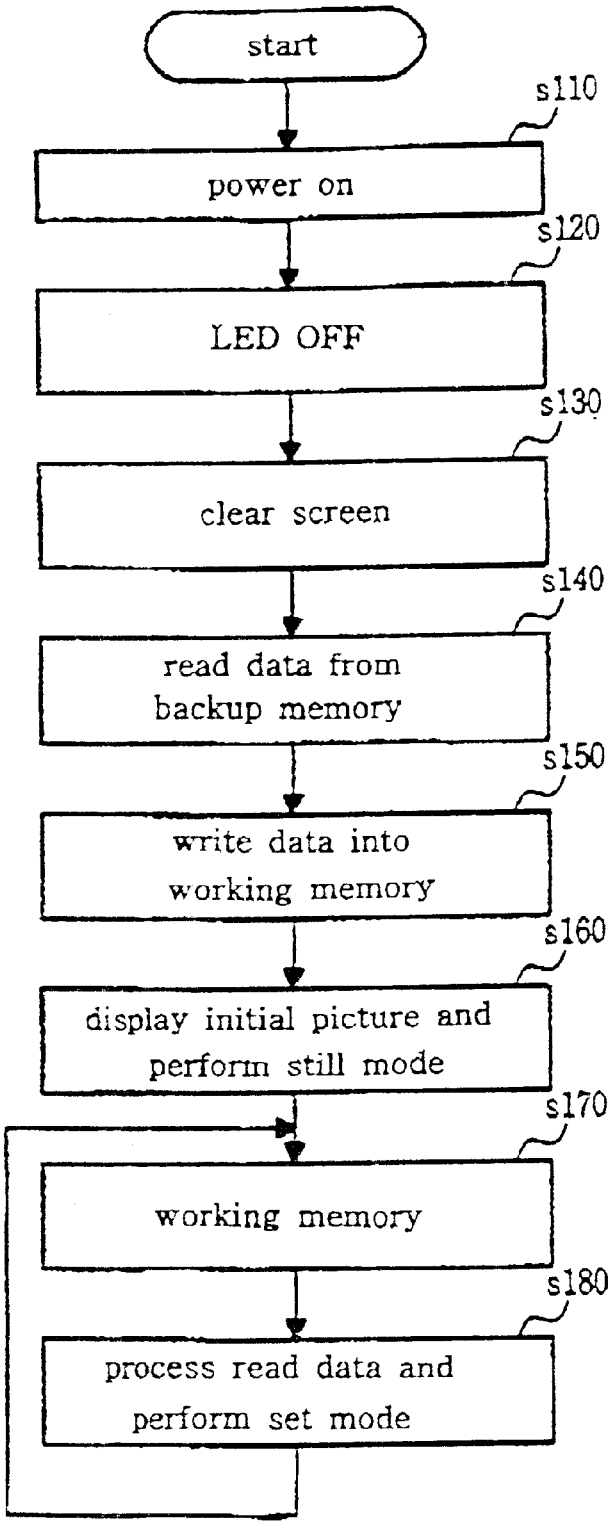
FIG. 16 is a flowchart illustrating a character and/or image display method in accordance with the present invention.

FIG. 16 is a flowchart illustrating a character and/or image display method in accordance with the present invention. First, if the character and/or image display apparatus 1000 is powered on (s110), then the logic control unit turns off the LEDs and clears the screen (s120). Thereafter, the logic control unit 200 reads all data stored in the nonvolatile backup memory 295' (s130) and writes the read data into the working memory 295 (s140). Subsequently, the logic control unit 200 reads initialization data from the working memory 295 (s150), displays an initial picture and performs a still mode (s160). The logic control unit 200 reads data other than the initialization data from the working memory 295 (s170), processes the read data and performs a set mode (s180). Then, the logic control unit 200 repeats the above steps s170 and s180 until it processes all the data read from the working memory 295.

In the present invention, data regarding the operating states of the character and/or image display apparatus, such as a moving state, blinking state, etc. are storable in the backup memory 295'. The logic control unit 200 basically performs the still mode at the above step s160 and proceeds to the subsequent mode if the rotation speed of the motor becomes stable.

Figure 17A:
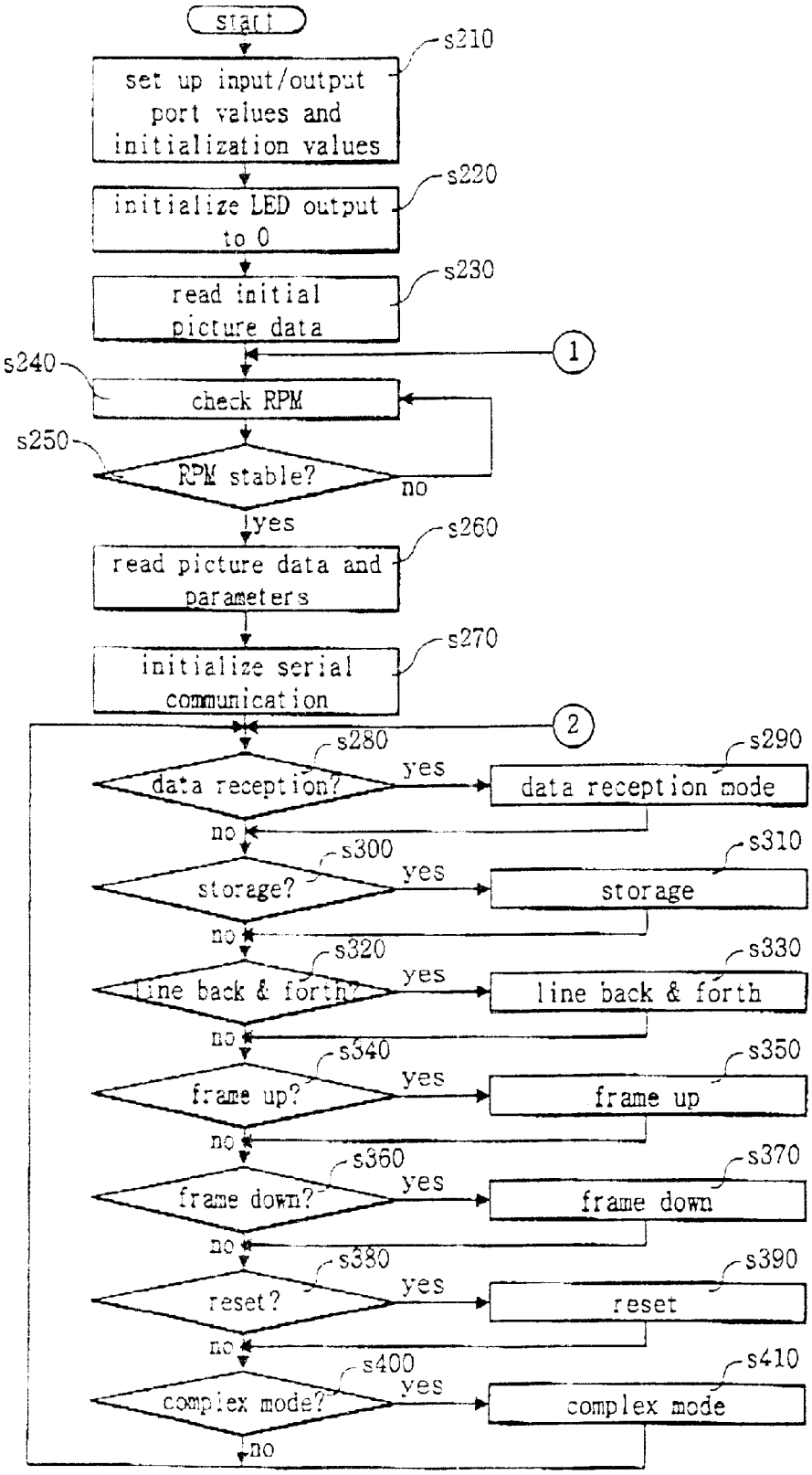
FIGS. 17(*a*), 17(*b*) and 17(*c*) are a detailed flowchart of the character and/or image display method in FIG. 16.

FIG. 17 is a detailed flowchart of the character and/or image display method in FIG. 16. In FIG. 17*a*, first, if the display apparatus 1000 of the present invention is powered on, then the logic control unit 200 sets up input/output port values and initialization values (s210) and initializes the LED output to 0 (s220). Then, the logic control unit 200 reads initial picture data from the working memory 295 (s230). In this step s230, the logic control unit 200 reads data associated with only one frame from the working memory 295 and performs the steps s130 to s160 in FIG. 16.

Thereafter, the logic control unit 200 checks the rpm of the motor (s240) to determine whether it is stable (s250). If the rpm of the motor is unstable, the logic control unit 200 repeats the above steps s240 and s250 until it becomes stable. In other words, the display apparatus displays the initial picture at the still mode until the rotation speed becomes stable.

If the rpm of the motor becomes stable, then the logic control unit 200 reads picture data and parameters stored in the working memory 295 (s260) and initializes the serial communication (s270). If the serial communication is initialized, then the logic control unit 200 processes modes based on programmed commands. That is, the logic control unit 200 checks a given command, performs the corresponding command, checks the subsequent command, performs the corresponding command and repeats this procedure (s280–s400). If a data reception command is given (s280), the logic control unit 200 performs a data reception mode (s290). In this manner, the logic control unit 200 performs a data storage mode (s310) if the given command is a data storage command (s300), a line back & forth mode (s330) if a line back & forth command (s320), a frame up mode (s350) if a frame up command (s340), a frame down mode (s370) if a frame down command (s360), a reset mode (s390) if a reset command (s380) and a complex mode (s410) if a complex command (s400), respectively.

Figure 17B:
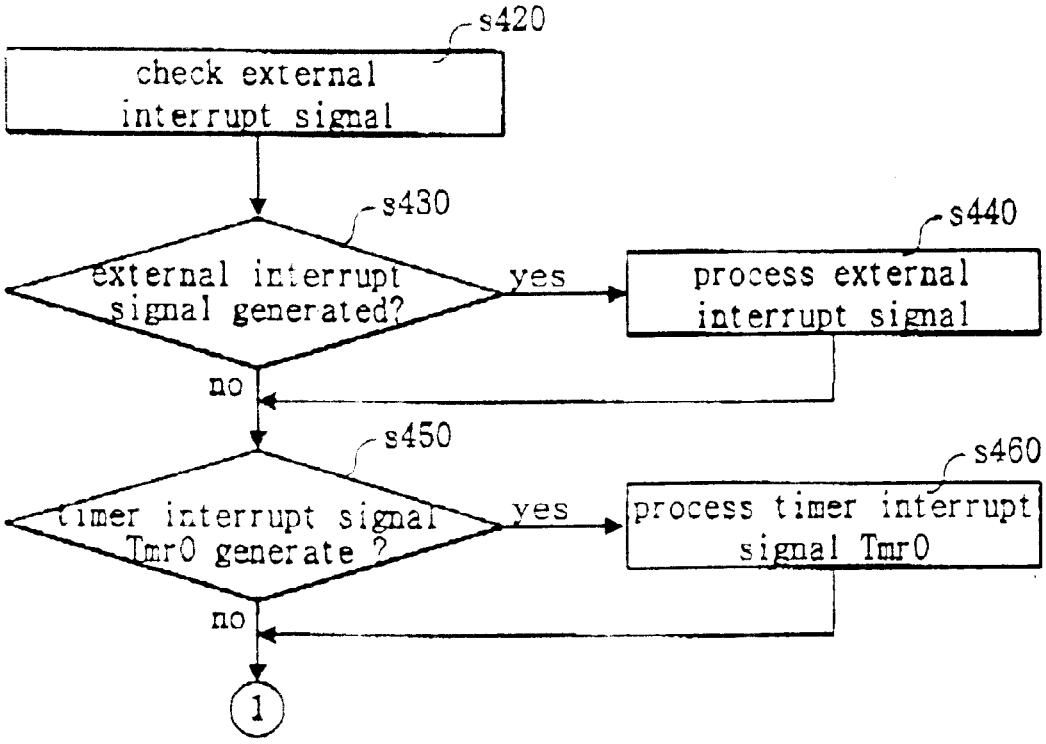

In FIG. 17*b*, in the initial state of the operation of the present display apparatus, the logic control unit 200 checks whether there is an interrupt signal from an external component (sensor) (s420 and s430). The logic control unit 200 processes an external interrupt signal if it is present (s440) and checks whether there is a timer interrupt signal Tmr0 indicative of an inter-dot time period if there is no external interrupt signal (s450). In the case where the timer interrupt signal Tmr0 is present, the logic control unit 200 processes it (s460) and then proceeds to the above step s230 of reading the initial picture data (⓪).

Figure 17C:
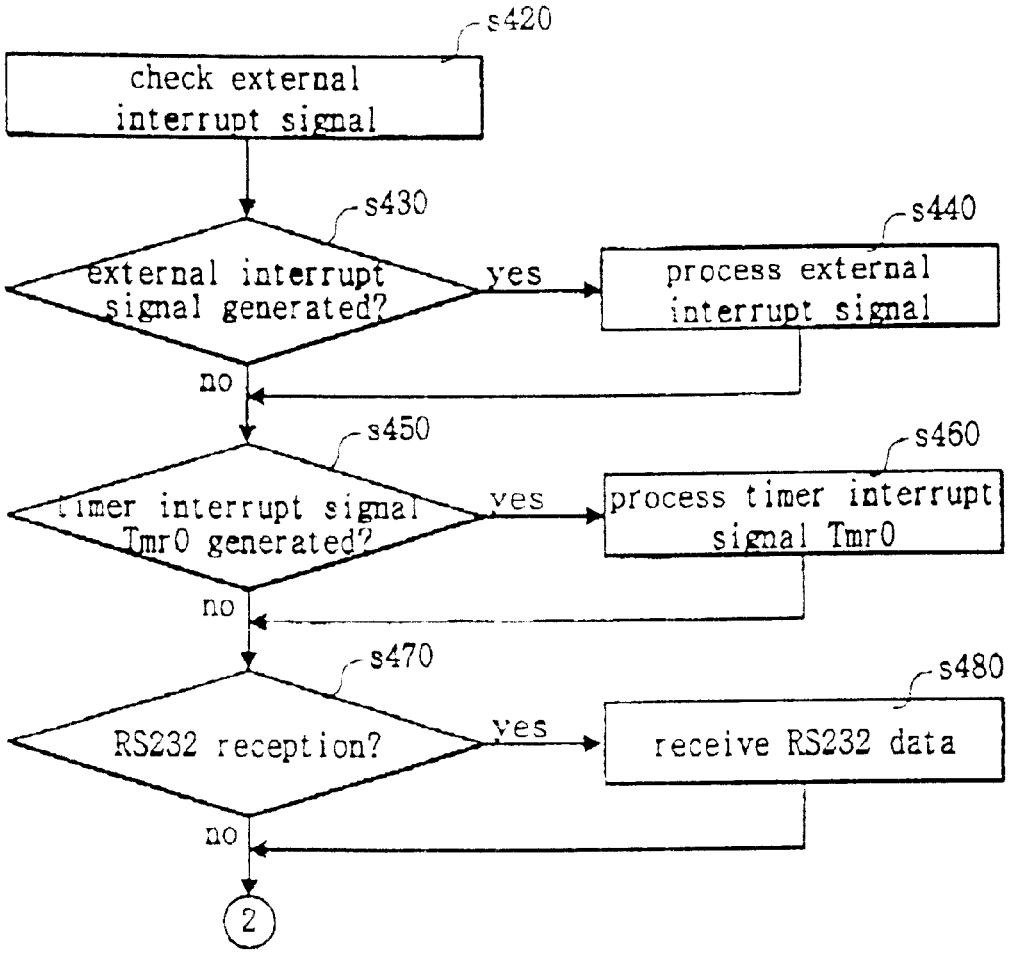

FIG. 17*c* shows a procedure during communication or in the case where there is an interrupt signal from a sensor. After performing the above step s270 of initializing the serial communication, the logic control unit 200 checks whether an external interrupt signal is present at the above steps s280 to s400 (s420 and s430). The logic control unit 200 processes an external interrupt signal if it is present (s440) and checks whether there is a timer interrupt signal Tmr0 indicative of an inter-dot time period if there is no external interrupt signal (s450). The logic control unit 200 processes the timer interrupt signal Tmr0 in the case where it is present (s460). However, if the timer interrupt signal Tmr0 is not present, the logic control unit 200 determines whether RS232 data has been received (s470) and receives the RS232 data (s480). In this manner, if an interrupt signal is generated at the above steps s280 to s400, then the logic control unit 200 stops the current task, stores it, processes the generated interrupt signal and then performs the stopped task again.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for displaying characters and/or images, comprising:

a rotary wing assembly consisting of light emitting diodes (LEDs) and a rotary wing;

a logic control unit controlling said LEDs of the rotary wing assembly to allow the LEDs to display desired characters and/or desired images;

a balance unit consisting of a balance plate and a balance weight, said balance unit being assembled with said logic control unit at a position opposite to the rotary wing assembly so as to accomplish a desired balance of said rotary wing assembly regardless of a difference in the center of gravity between said rotary wing assembly and said logic control unit during a rotating action of said rotary wing assembly;

a motor unit consisting of a stator, a rotor, a hollow motor shaft having an axial passage and extending through both said stator and said rotor and being connected to both the rotor and the logic control unit at its opposite ends so as to rotate the rotary wing assembly, the logic control unit and the balance unit at the same time by a rotating force of said rotor, and a rotor holder used for combining the logic control unit with the motor shaft;

a switch mode power supply (SMPS) used for supplying a direct current (DC) power to said logic control unit in a contactless manner, and mounted to a lower end of said motor shaft so as to be rotatable together with the motor shaft at the same time, said SMPS consisting of a primary board and a secondary board, said primary board transmitting both external alternating current (AC) voltage and external input data to said secondary board, and said secondary board being electrically connected to both the rotary wing assembly and the logic control unit through electric wires passing through the axial passage of said hollow motor shaft, thus transmitting the power and data to both the rotary wing assembly and the logic control unit;

a data communication unit consisting of a modem board and an RS-232 board, and being used for transmitting external input data to said logic control unit;

a display bulb covering the top of said rotary wing assembly, said logic control unit and said motor unit while forming a sealed space in the bulb, said display bulb allowing a user to observe characters and/or images displayed by the LEDs from the outside of the bulb; and an external casing mounted to a lower end of said display bulb and encasing said motor unit, said SMPS and said data communication unit.

2. The apparatus for displaying characters and/or images as set forth in claim 1, wherein said logic control unit includes:

a micro controller;

a backup memory for storing data necessary to the operation of said display apparatus, said backup memory being of a nonvolatile type;

a working memory for reading the data stored in said backup memory;

a data latch buffer for latching data from said working memory by a predetermined number of vertical dots;

a latch clock generator for supplying clock data to said data latch buffer in response to an input/output control signal from said micro controller;

an LED data driver for reading data from said data latch buffer in response to the clock data from said latch clock generator; and an LED array for displaying data under control of said LED data driver.

3. The apparatus for displaying characters and/or images as set forth in claim 1 or 2, wherein the balance between the rotary wing assembly and the logic control unit is accomplished by adjusting the weight of said balance weight.

4. The apparatus for displaying characters and/or images as set forth in claim 3, wherein said balance weight is covered with a balance weight cover at its top and bottom, thus being prevented from undesirably coming into contact with said display bulb or from scratching the display bulb during an assembling process of the display apparatus.

5. The apparatus for displaying characters and/or images as set forth in claim 3, wherein each of said LEDs is free from a flange radially projecting outward from a sidewall of an LED mold of each LED.

6. The apparatus for displaying characters and/or images as set forth in claim 5, wherein each of said LEDs has one or more LED chips arrayed in one LED mold in a horizontal, vertical, diagonal, or triangular arrangement.

7. The apparatus for displaying characters and/or images as set forth in claim 3, wherein said logic control unit is covered with a cover at its circular end portion to reduce noises and air resistance during a rotating action of said logic control unit.

8. The apparatus for displaying characters and/or images as set forth in claim 3, where a secondary side of said SMPS is supposed to be turned on when a primary side thereof is turned off, and said SMPS includes:

an AC input unit;

a DC converter for converting an AC voltage from said AC input unit into a DC voltage;

a pulse width modulation (PWM) control/generation circuit for controlling the output of the DC voltage converted by said DC converter to generate a high voltage;

a high voltage/low voltage converter for converting the high voltage from said PWM control/generation circuit into a low voltage;

a smoothing circuit for smoothing the low voltage converted by said high voltage/low voltage converter; and an output voltage detector for detecting a voltage signal from said smoothing circuit and transferring the detected voltage signal to said PWM control/generation circuit.

9. The apparatus for displaying characters and/or images as set forth in claim 4, wherein said balance weight is a screw-type balance weight or a compression-type balance weight.

10. The apparatus for displaying characters and/or images as set forth in claim 1, wherein said motor unit is an induction motor unit, with the stator and a motor casing of said motor unit being rotatable at the same time while accomplishing a rotational symmetry around the hollow motor shaft.

11. The apparatus for displaying characters and/or images as set forth in claim 1, wherein an electric wire and a data communication wire from said secondary board of the SMPS pass through the passage of the motor shaft prior to being connected to said logic control unit.

12. The apparatus for displaying characters and/or images as set forth in claim 1, wherein said secondary board of the SMPS is provided with a transparent optical sensor unit, said sensor unit being integrally formed with a light emitting part and a light receiving part for sensing both a rotating velocity of said rotor of the motor unit and an initial rotating point of the rotor.

13. The apparatus for displaying characters and/or images as set forth in claim 1, wherein an optical transistor is mounted to a central position of a ferrite core, said optical transistor being used for optically receiving a variety of data transmitted through a power feedback signal IR (infra-red) of said secondary board of the SMPS or through a power feedback signal IR of said primary board of the SMPS.

14. The apparatus for displaying characters and/or images as set forth in claim 13, wherein the various data are transmitted from cellular phones, pagers, FM tuners, digital radio systems, RS-232, modems, and keys.

15. The apparatus for displaying characters and/or images set forth in claim 1, wherein said primary and/or secondary ferrite core forms the secondary side of the EE or EI core formed in the shape of a circle or square.

16. The apparatus for displaying characters and/or images set forth in claim 3, wherein said primary and secondary-side bobbins of the SMPS are separated from each other, said secondary-side bobbin is situated inside primary-side bobbin while being upwardly spaced somewhat apart from the primary-side bobbin, and said primary-side bobbin is mounted to be fixed and said secondary-side bobbin is mounted to be rotated.

17. The apparatus for displaying characters and/or images set forth in claim 16, wherein said primary and secondary-side bobbins of the SMPS are laterally spaced somewhat apart from each other, and the primary-side bobbin of the SMPS is mounted to be fixed and the secondary-side bobbin of the SMPS is mounted to be rotated.

18. The apparatus for displaying characters and/or images as set forth in claim 1, wherein the modem board is connected to external communication means via stereo- or mono-phone jacks, said stereo- or mono-phone jacks being mounted on the inside-support bracket.

19. A method for displaying characters and/or images comprising the steps of:

a) applying power to a character and/or image display apparatus and setting up input/output port values and initialization values;

b) initializing all LED values and clearing a screen;

c) reading initial picture data from a nonvolatile backup memory;

d) writing the data read from said backup memory into a working memory;

e) reading initialization data from said working memory;

f) displaying an initial picture and performing a still mode until a rotation speed of a motor becomes stable;

g) reading data other than the initialization data from said working memory;

h) sequentially performing modes corresponding to commands contained in the read data; and i) repeating said steps g) and h) until all commands stored in said working memory are processed.

20. The method for displaying characters and/or images as set forth in claim 19, wherein said commands include a data reception command, a data storage command, a line back & forth command, a frame up command, a frame down command, a reset command and a complex command.

* * * * *

UNITED STATES PATENT AND TRADEMARK OFFICE

CERTIFICATE OF CORRECTION

PATENT NO. : 6,380,686 B1
DATED : April 30, 2002
INVENTOR(S) : Jae Chul Kim et al.

It is certified that error appears in the above-identified patent and that said Letters Patent is hereby corrected as shown below:

Column 7,
Line 1, “are a detailed diagram” should read -- are detailed diagrams --.
Line 6, “are a view” should read -- are views --.
Line 19, “are a view” should read -- are views --.
Line 33, “are a detailed flowchart” should read -- are detailed flowcharts --.

Column 12,
Line 24, after “(switch mode power supply)” delete period “.”.

Signed and Sealed this

Twenty-fourth Day of September, 2002

*Attest:*

*Attesting Officer*

JAMES E. ROGAN
*Director of the United States Patent and Trademark Office*